US005594417A

United States Patent [19]

Morita

[11] Patent Number: 5,594,417

[45] Date of Patent: Jan. 14, 1997

[54] FIRE ALARM SYSTEM

[75] Inventor: Toshikazu Morita, Tokyo, Japan

[73] Assignee: Nohmi Bosai, Ltd., Tokyo, Japan

[21] Appl. No.: 348,975

[22] Filed: Nov. 28, 1994

[30] Foreign Application Priority Data

Dec. 2, 1993 [JP] Japan ..... 5-303073
Dec. 9, 1993 [JP] Japan ..... 5-309361

[51] Int. Cl.[6] ..... G08B 29/00

[52] U.S. Cl. ..... 340/506; 340/505; 340/588; 340/514; 340/511

[58] Field of Search ..... 340/506, 505, 340/825.06–825.11, 588, 589, 514, 511

[56] References Cited

U.S. PATENT DOCUMENTS 4,507,652 3/1985 Vogt et al. ..... 340/505
4,785,283 11/1988 Yuchi ..... 340/511
5,168,262 12/1992 Okayama ..... 340/514

FOREIGN PATENT DOCUMENTS 2634928 2/1990 France .
2203577 10/1988 United Kingdom .

*Primary Examiner*—Donnie L. Crosland

*Attorney, Agent, or Firm*—Wenderoth, Lind & Ponack

[57] ABSTRACT

A fire alarm system exhibiting satisfactory reliability and capable of easily and assuredly setting address and various discrimination values to terminal units. The fire alarm system has a setting unit including a first command unit, a first discrimination unit for discriminating whether or not a transmitted set value transmitted by the first command unit and a set value received from a detector coincide with each other, a second command unit for transmitting the set value to the detector when the received set value and the transmitted set value coincide with each other, and a second discrimination unit for discriminating whether or not the received set value and the set value transmitted from the first or the second command unit coincide with each other. The fire alarm system further includes the fire detector having a first response unit for transmitting, to the setting unit, a first response signal and the received set value when the output from the first command unit has been received, a second response unit for transmitting a second response signal and the received set value when the set value received when the output from the second command unit has been received and the set value received by the first response unit coincide with each other, and a writing unit for storing a result of discrimination in an EEPROM when the two set values received by the second response unit coincide with each other.

16 Claims, 15 Drawing Sheets

SETTING UNIT
FIRE DETECTOR

AD(C) ST(A) AD(n) SUM1
CF(A) AD(n) SUM2

AD(C) NT(A) AD(n) SUM1
UN(A) AD(n) SUM2

AD(C) CL(A) SUM1
BUSY

AD(C) CL(A) SUM1
RP(A) AD(n) SUM2

AD(C) ST(L) FL(n) SUM1
CF(L) FL(n) SUM2

AD(C) NT(L) FL(n) SUM1
UN(L) FL(n) SUM2

AD(C) CL(L) SUM1
BUSY

AD(C) CL(L) SUM1
RP(L) FL(n) SUM2

FIRE ALARM SYSTEM

BACKGROUND OF THE INVENTION

1. Field of the Invention

This invention relates to a fire alarm system, and more particularly to a fire alarm system, to which terminal units, such as fire detectors, manual boxes and transmitters (transmitters for supervising fire detectors and manual boxes or transmitters for controlling local sound units, fire block doors, smoke blocking and exhausting units and fire extinguishing units) are connected.

2. Description of the Related Art

Hitherto, there has been a fire alarm system, such as a fire alarm system, in which a multiplicity of terminal units, such as transmitters to which one or more types of controlled units, such as fire detectors and manual boxes or fire detectors, local sound units and smoke blocking and exhausting units are connected, are installed. When each terminal unit is given individual address (self-address) or when various discrimination values (for example, a threshold for discriminating a fire, a threshold for discriminating a trouble, a threshold for testing an false alarm issue and miss alarm issue, accumulation time, timer set time and the like) are set, so-called dip switches are provided for the terminal units to perform the setting operation or the set values are previously stored in a mask ROM or an EPROM in the manufacturing process.

Since the conventional fire alarm system uses the dip switches, the mask ROM or the EPROM to set individual address for each terminal unit and a variety of discrimination values, use of the dip switch enables the address or the like to be changed easily at the spot at which the terminal unit is disposed after the terminal unit has been installed. However, there arises a problem in that the setting operation performed by using hexadecimal notation is too complicated and an error in setting to take place easily. What is worse, the set values can be changed by tampering or the set values can be disordered easily due to vibrations or the like.

Although use of the ROM or the EPROM enables the disorder of the set values due to vibrations to be prevented, the set values cannot be changed or an ultraviolet-ray eraser unit is required to erase the stored contents. Although the erase operation can be performed in the manufacturing process, the contents cannot be changed at the spot at which the terminal unit is installed. What is even worse, setting can be performed erroneously. If the address or the like is changed after the terminal unit has been installed, change to a new ROM or the like that has a new address is required. Thus, there arise problems in that complicated arranging and changing operations are required and that breakage of a pin of the ROM or the like and defective contact takes place on the situation.

In order to overcome the foregoing problems, a method has been suggested in which the address of the terminal unit is set from the fire receiver. The foregoing method has an arrangement that the terminal unit, the address of which is intended to be set, is called and a new address is transmitted to be set to the terminal unit.

In this case, the fire receiver calls the terminal unit, the address of which is intended to be changed, by using the present address and the new address is written on the called terminal unit. Although no problem takes place in a case where the new address is not used by another terminal unit, a plurality of terminal units having the same address are inevitably present if the same address as that of the other terminal unit is used. Therefore, there arises a risk that a plurality of terminal units simultaneously respond to a fire supervision. As a result, a problem arises in that the address cannot smoothly and accurately be set.

In a case where the method of the foregoing type is employed, a problem arises in that, if the address or the like is intended to be set to a new terminal unit having no set address, the fire receiver cannot call the terminal unit because the terminal unit has no address.

Since the method of the foregoing type, in which the address peculiar to each terminal unit is used to set the discrimination value, such as the address, is employed, a problem rises in that polling in a normal fire supervisory operation causes the terminal unit to erroneously perform an operation of setting the address or the like.

SUMMARY OF THE INVENTION

The present invention is directed to overcoming the foregoing problems, and an object of the present invention is to provide a fire alarm system which is easy to operate, highly reliable in operation and capable of easily and reliably setting addresses and various discrimination values to terminal units.

According to one aspect of the present invention, there is provided a fire alarm system comprising a plurality of terminal units and a setting unit for setting a variety of set values to the terminal units. The setting unit comprises: first command means for transmitting a first command and the set value to the terminal unit; first discrimination means that receives a first response signal and the set value from the terminal unit in accordance with the first command to discriminate whether or not the set value received from the terminal unit coincides with the set value transmitted by the first command means; second command means for transmitting the second command and the set value to the terminal unit when the first discrimination means has discriminated that the set value received from the terminal unit coincides with the set value transmitted by the first command means; second discrimination means that receives a second response signal and the set value from the terminal unit in accordance with the second command to discriminate whether or not the set value received from the terminal unit coincides with the set value transmitted by the first command means or the second command means; and a third discrimination means for discriminating whether or not the state in which the set value of the terminal unit is valid in accordance with the result of discrimination performed by the second discrimination means. The terminal unit comprises: first response means that receives the first command and the set value from the first command means to transmit a first response signal and the received set value to the setting unit; second response means that receives the second command and the set value from the second command means to discriminate whether or not the received set value coincides with the set value received by the first response means and transmit a second response signal and the received set value to the setting unit when the two set values coincide with each other; and writing means for storing a result of discrimination in storage means when the second response means has discriminated that the two received set values coincide with each other.

With the above arrangement, sitting of the address and the various discrimination values for the terminal units can easily and reliably set. Furthermore, undesirable changes in the set data such as the address and the various discrimination values of the terminal units due to polling from the receiving portion can be prevented when the system operates normally. In addition, undesirable changes in the set data in the terminal units due to tampering can be prevented.

In a preferred form of the present invention, the third discrimination means comprises: third command means for transmitting a third command for requiring a set value of the same type as those transmitted by the first command means and the second command means to the terminal unit when the second discrimination means has discriminated that the set value received from the terminal unit coincides with the set value transmitted by the first command means or the second command means; fourth discrimination means for discriminating whether or not the set value received from the terminal unit in accordance with the third command coincides with the set value transmitted by the first command means or the second command means; and display means for displaying the result of discrimination. The terminal unit further comprises third response means that reads, from the storage means, the set value specified by the third command when the third command has been received from the third command means to transmit the set value, which has been read, to the setting unit. As a result of the foregoing arrangement, the address and the various discrimination values for the terminal units can easily and reliably be set. Thus, the reliability can be improved.

In another preferred form of the present invention, the setting unit further comprises: fourth command means for transmitting a fourth command that specifies the type of the set value and requires the set value to the terminal unit; and display means for displaying the set value received from the terminal unit in accordance with the fourth command. The terminal unit further comprises fourth response means that reads, from the storage means, the set value specified in accordance with the fourth command when the fourth command has been received from the fourth command means to transmit the read set value to the setting unit. As a result of the foregoing arrangement, the set value is accurately and sufficiently confirmed so that an erroneous system recognition can be prevented and erroneous adjustment can be prevented.

In a further preferred form of the present invention, a common address is set for a plurality of terminal units, and the first to fourth command means of the setting unit simultaneously transmit the common address, and the first to fourth response means discriminate whether or not the command and the set value or the command together with the common address have been received. As a result, even if the address of a terminal unit is unknown, data set for the terminal unit can be read to know the content. Thus, the common address is used to easily and reliably set the address and various set values for each terminal unit.

According to another aspect of the present invention, there is provided a fire alarm system comprising a plurality of terminal units and a setting unit for setting a variety of set values to the terminal units. The setting unit comprises: input means for inputting a variety of discrimination values; discrimination means for discriminating the variety of discrimination values inputted by the input means; and transmission means that adds a common address to the discrimination values discriminated by the discrimination means to transmit the discrimination values having the common address to the terminal unit. The terminal unit comprises: receiving means for receiving information transmitted by the setting unit; discrimination means for discriminating the common address in accordance with an output from the receiving means and for discriminating the discrimination value in accordance with an output from the receiving means when the common address has been received; and writing means for storing, together with the common address, a result of discrimination performed by the discrimination means into an electrically rewritable non-volatile storage means. With this arrangement, the address and various discrimination values of the terminal units can easily and reliably set. When address or the like is given to a new terminal unit having no address, the setting unit is able to reliably call the terminal unit. Furthermore, erroneous address setting operation performed by the terminal unit due to polling of the fire receiver can be prevented in the normal supervisory state. Thus, the discrimination values including the address can reliably be set.

In a preferred form of the present invention, the discrimination means of the setting unit comprises: setting discrimination means for discriminating whether or not an input from the input means is setting; and requirement discrimination means for discriminating whether or not the input from the input means requires the terminal unit to return information. As a result of this arrangement, address and various discrimination values of the terminal units can easily and further reliably be set. Thus, the reliability can be further improved.

In a further preferred form of the present invention, the discrimination means comprises: address setting discrimination means for discriminating whether or not the input from the input means is setting of address; and discrimination value setting discrimination means for discriminating whether or not the input from the input means is setting of the discrimination value. The requirement discrimination means comprises: address requirement discrimination means for discriminating whether or not the input from the input means requires the terminal unit to return the address; and discrimination value requirement discrimination means for discriminating whether or not the input from the input means requires the terminal unit to return the discrimination value. With this arrangement, if the self-address of the terminal unit or the discrimination value such as a threshold for discriminating a fire is unknown, the command for requiring the discrimination value can be transmitted from the setting unit to the terminal unit together with the common address. Therefore, the discrimination value can be easily known and accurately confirmed so that the erroneous recognition in the system can be prevented, thus avoiding erroneous adjustments.

In a further preferred form of the present invention, the discrimination means of the setting unit further comprises discrimination value discrimination means for discriminating whether or not the discrimination value returned from the terminal unit and the discrimination value input by the input means coincide with each other. As a result of this arrangement, the common address is used so that setting the address and the various discrimination values of each terminal unit is performed easily and assuredly.

In a further preferred form of the present invention, the setting unit further comprises: receiving means that receives information from the terminal unit to supply the same to the discrimination value discrimination means; and display means for displaying a result of discrimination performed by the discrimination value discrimination means. With this arrangement, even if the address of the terminal unit is unknown, data set for the terminal unit can be read to know the content thereof. Furthermore, the common address is used so that setting the address and the various discrimination values of each terminal unit is performed easily and assuredly.

In a further preferred form of the present invention, the discrimination means of the terminal unit comprises: common address discrimination means that makes reference to the storage means in accordance with an output from the receiving means to discriminate whether or not the common address has been received; setting command discrimination means for discriminating whether or not the setting command has been, together with the common address, received in accordance with an output from the receiving means when the common address discrimination means has discriminated receipt of the common address; and requirement command discrimination means for discriminating whether or not the discrimination value requirement command has been, together with the common address, received in accordance with an output from the receiving means when the common address discrimination means has discriminated receipt of the common address. As a result of this arrangement, the address and the various discrimination values can further easily and reliably set for the terminal units. Therefore, the reliability can be improved.

In a preferred form of the present invention, the setting command discrimination means comprises: address setting command discrimination means for discriminating whether or not the received setting command is the address setting command when the common address discrimination means has discriminated receipt of the common address; and discrimination value setting command discrimination means for discriminating whether or not the receiving setting command is the discrimination value setting command when the common address discrimination means has received the common address. As a result of this arrangement, the address and the various discrimination values of the terminal units can be set further easily and reliably. Thus, the reliability can be further improved.

In a further preferred form of the present invention, the terminal unit further comprises transmitting means that reads, from the non-volatile storage means, a discrimination value corresponding to a requirement command received after the common address has been received so as to transmit the discrimination value to the setting unit. This also serves for easy and reliable setting of the address and the various discrimination values of the terminal units.

DESCRIPTION OF THE PREFERRED EMBODIMENT

An embodiment of the present invention will now be described with reference to the drawings, in which fire detectors are used as the examples of the terminal units to which setting will be made.

Figure 1:
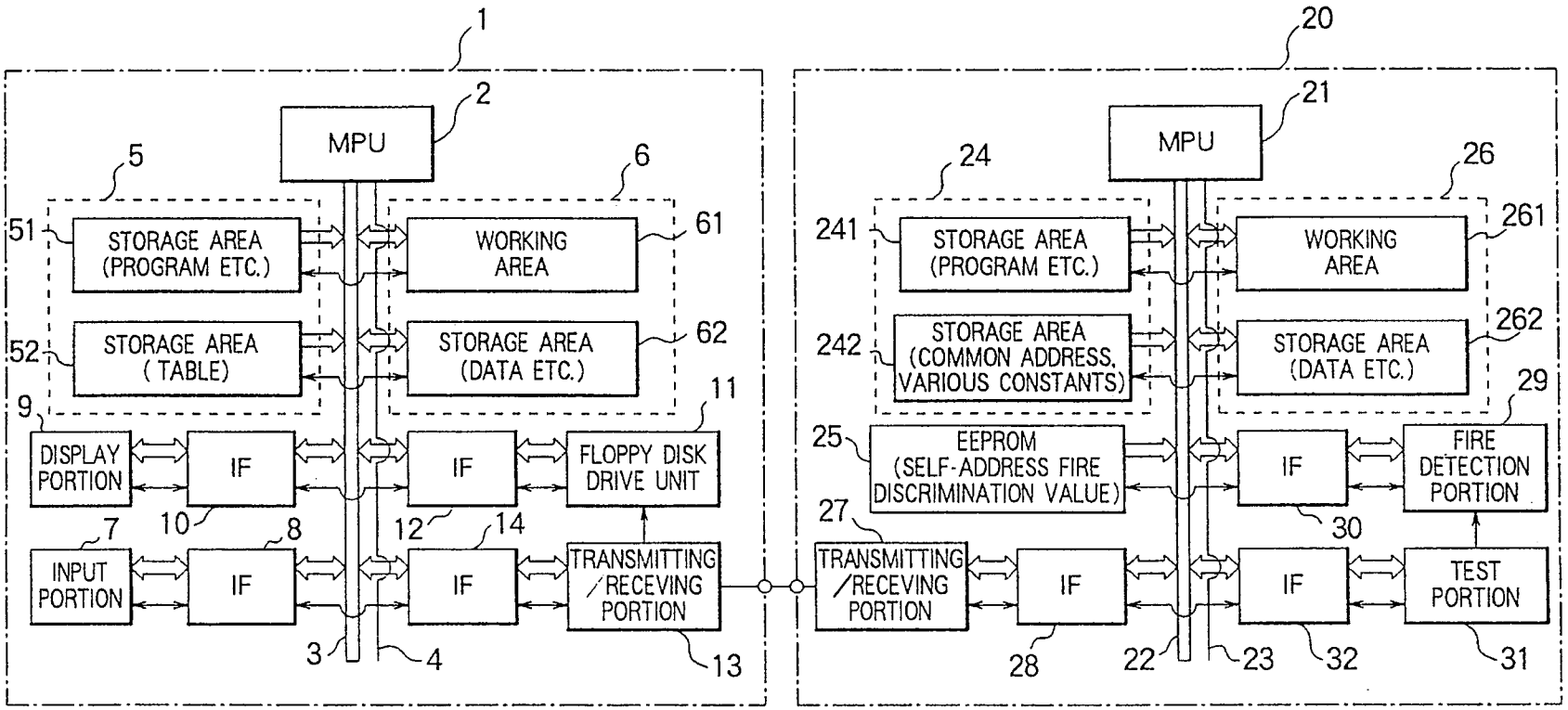
FIG. 1 is a block diagram which illustrates an embodiment of a fire alarm system according to the present invention.

FIG. 1 is a block diagram which illustrates an embodiment of the present invention.

Referring to FIG. 1, a setting unit 1 is used to set data for setting addresses and various discrimination values (for example, a threshold for discriminating a fire, a threshold for discriminating a trouble, a threshold for testing an false alarm and a miss alarm, the accumulation time, timer set time for control, a reference value for calculating an analog level and the like) to a fire alarm system including fire detectors, manual boxes, transmitters and the like or a fire extinguishing system at a manufacturing plant or the spot at which a terminal unit of the system is installed. The setting unit 1 may be an exclusive unit or a personal computer.

The setting unit 1 comprises a microprocessor unit (hereinafter called an "MPU") 2 serving as a calculation means for performing a variety of calculating operations to be described later, a data bus 3 and a control bus 4 respectively connected to the MPU 2 and a read-only-memory (hereinafter called a "ROM") 5 connected to the MPU 2 through the data bus 3 and the control bus 4. The ROM 5 includes a storage area 51, in which a program relating to a flow chart to be described later and shown in FIGS. 4 and 5 and the like are previously stored, and a storage area 52 in which collation tables between input data and output data, between input or received data and displayed data and the like are previously stored. The setting unit 1 further comprises a random access memory (hereinafter called a "RAM") 6 connected to the MPU 2 through the data bus 3 and the control bus 4, an input portion 7, such as a keyboard, connected to the MPU 2 through an interface (hereinafter called an "IF") 8, the data bus 3 and the control bus 4, and a display portion 9, such as a liquid crystal panel, a CRT, a count display tube or a display lamp, connected to the MPU 2 through an IF 10, the data bus 3 and the control bus 4. The RAM 6 comprises a storage area 61 for use in a case where the MPU 2 performs the calculating operation and a storage area 62 for temporarily storing data to be transmitted, received data, set data and the like.

The setting unit 1 further comprises a floppy disk drive unit 11 connected to the MPU 2 through an IF 12, the data bus 3 and the control bus 4 to cause set data or the like to be stored in a floppy disk or to read set data made previously in another place, and a transmitting/receiving circuit 13 serving as a transmitting means connected to the MPU 2 through an IF 14, the data bus 3 and the control bus 4 and composed of a parallel/series conversion circuit, a transmitting circuit, a receiving circuit, a series/parallel conversion circuit (not shown) for transmitting/receiving information to and from a terminal unit to be described later. The floppy disk drive unit 11 may be an input/output unit for an IC card or a unit for connecting a personal computer.

A fire detector 20, serving as the terminal unit, comprises an MPU 21 serving as a calculation means for performing a variety of calculating operations to be described later, a data bus 22 and a control bus 23 respectively connected to the MPU 21, a ROM 24 connected to the MPU 21 through the data bus 22 and the control bus 23, and an EEPROM 25, which is an electrically rewritable and erasable non-volatile memory which is connected to the MPU 21 through the data bus 22 and the control bus 23 and in which self-address, which is the address to be set, and a fire discrimination value serving as an example of the set discrimination value are stored. The ROM 24 includes a storage area 241, in which a program relating to a flow chart to be described later and shown in FIGS. 7 to 9 and the like are previously stored, and a storage area 242 in which address common to the terminal units and various constant are previously stored. As an alternative to use of the EEPROM 25, a RAM with a backup power source or the like may be used.

The fire detector 20 comprises a RAM 26 connected to the MPU 21 through the data bus 22 and the control bus 23, a transmitting/receiving circuit 27 serving as a transmitting means connected to the MPU 21 through an IF 28, the data bus 22 and the control bus 23 and composed of a parallel/series conversion circuit, a transmitting circuit, a receiving circuit, a series/parallel conversion circuit and the like (not shown) for transmitting/receiving information to and from the setting unit 1, and a fire detection portion 29 serving as a detection means connected to the MPU 21 through an IF 30, the data bus 22 and the control bus 23 and arranged to detect a fire phenomenon, such as heat, smoke, flame, gas or smell to output its physical quantity. The RAM 26 comprises a storage area 261 for use in a case where the MPU 21 performs the calculating operation and a storage area 262 for updating and storing output denoting the detected fire phenomenon for several latest outputs. In a case where the transmitting/receiving circuit 27 is connected to a fire receiver or the like (not shown), it transmits/receives information to and from the fire receiver or the like and sets the address and the discrimination value. In a case where the fire detection portion 29 is, for example, a heat detector, it comprises a heat sensitive device, such as a thermistor and an A/D conversion circuit. In a case where it is a photoelectric type or a light obscuration type smoke detector, it comprises a light emission control circuit, a light emitting device, a light receiving device, an amplifying circuit, a sample and hold circuit, an A/D conversion circuit and the like. In a case where it is a ionization type smoke detector, it comprises an external ion chamber, an internal ion chamber, an FET, an A/D conversion circuit and the like. If it is a flame detector, it comprises a detection device, such as a pyroelectric device or an ultraviolet-ray detection device, an amplifying circuit, an A/D conversion circuit and the like. In a case where it is a gas-type or a smell-type detector, it comprises a gas detection device or a smell detection device, an A/D conversion circuit and the like.

The fire detector 20 comprises a testing portion 31 connected to the MPU 21 through an IF 32, the data bus 22 and the control bus 23, as well as connected to the fire detection portion 29 and arranged to supply a simulated fire signal, which is an electric signal, to the fire detection portion 29 to perform a test under control of the MPU 2.

Figure 2:
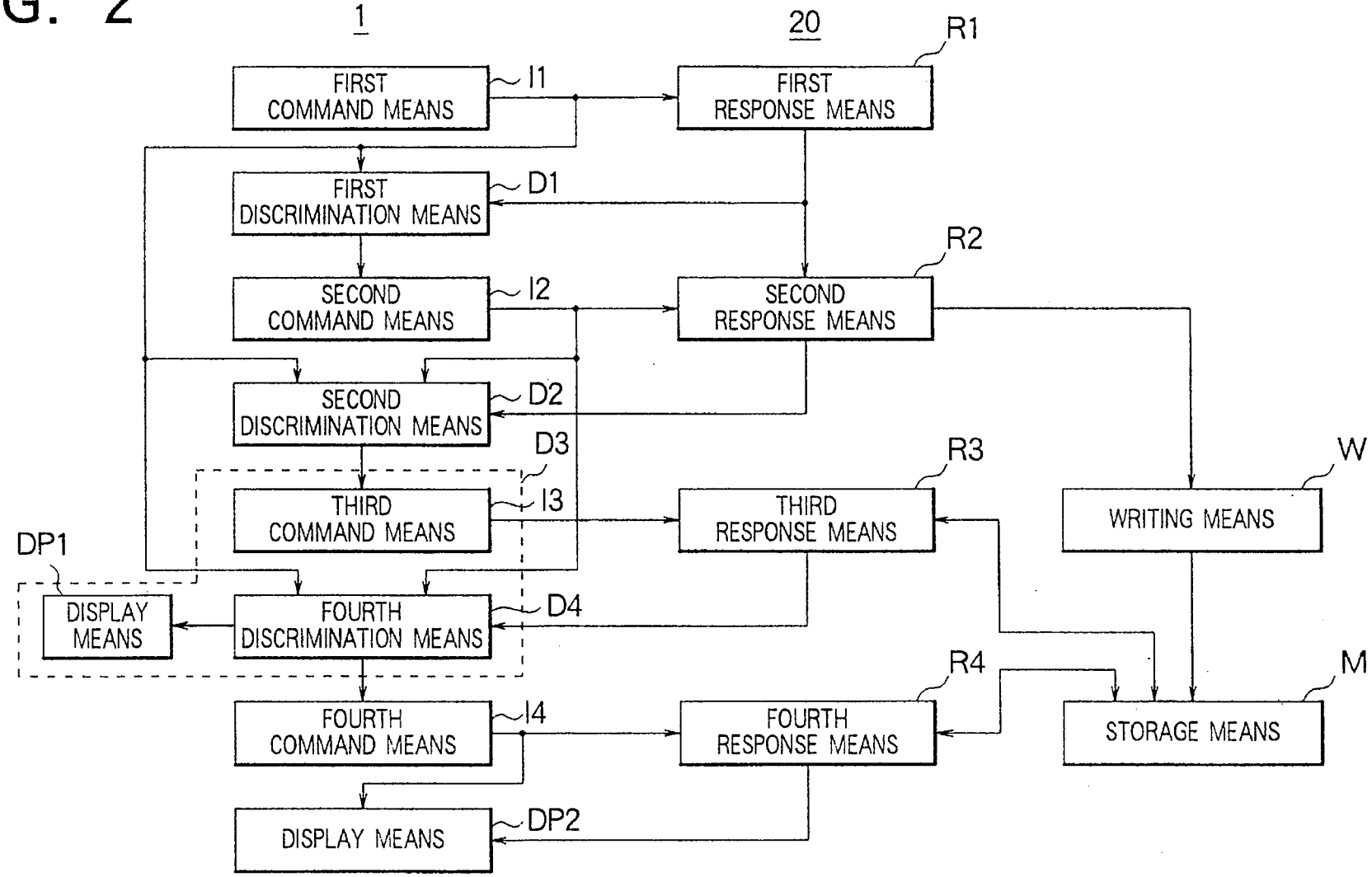
FIG. 2 is a block diagram which illustrates the embodiment of the present invention.

FIG. 2 is a block diagram which illustrates the function of the embodiment of the present invention.

Referring to FIG. 2, the setting unit 1 comprises: a first command means I1 for transmitting a first command (a start command) and a set value to the fire detector 20 serving as the terminal unit; a first discrimination means D1 that receives a fire response signal (a confirmation signal) and the set value supplied from the fire detector 20 in accordance with the first command and discriminates whether or not the set value supplied from the fire detector 20 coincides with the set value supplied from the first command means I1; a second command means I2 for transmitting a second command (a notification command) and the set value to the fire detector 20 when a discrimination is made that the set value supplied from the fire detector 20 coincides with the set value supplied by the first command means I1; a second discrimination means D2 that receives a second response signal (a recognition signal) and the set value supplied from the fire detector 20 in accordance with the second command and as well as discriminates whether or not the set value supplied from the fire detector 20 and the set value supplied from the first command means I1 or the second command means I2 coincide with each other; a third discrimination means D3 for, in accordance with the result of the discrimination performed by the second discrimination means D2, discriminating the validity of the state where the set value of the fire detector 20 is set; a fourth command means I4 for specifying the type of the set value to transmit a fourth command for requiring the set value; and a display means DP2 for displaying the set value received from the fire detector 20 in accordance with the fourth command. The third discrimination means D3 comprises: a third command means I3 for transmitting a third command for requiring a set value of the same type as the set value transmitted by the first command means I1 and the second command means I2 when a discrimination has been made by the second discrimination means D2 that the set value received from the fire detector 20 coincides with the set value transmitted by the, first command means I1 or the second command means I2; a fourth discrimination means D4 arranged such that, when the set value has been received from the fire detector 20 in accordance with the third command, it discriminates whether or not the received set value coincides with the set value transmitted by the first command means I1 or the second command means I2; and a display means DP1 for displaying the result of the discrimination made by the fourth discrimination means D4.

The first command means I1, the second command means I2, the fourth command means I4, the first discrimination means D1, the second discrimination means D2 and the third discrimination means D3 having the third command means I3 and the fourth discrimination means D4 are included in the MPU 2 (see FIG. 1) of the setting unit 1. The display means DP1 and DP2 are included in the display portion 9 (see FIG. 1) of the setting unit 1.

The fire detector 20 comprises a first response means R1 for transmitting a first response signal (a confirmation signal) and the received set value to the first discrimination means D1 of the setting unit 1 when the first command (the start command) and the set value have been received from the first command means I1; a second response means R2 having an arrangement that, when the second command (the notification command) and the set value have been received from the second command means I2, it discriminates whether or not the received set value coincides with the set value received by the first response means R1 and transmits a second response signal (recognition signal) and the received set value to the second discrimination means D2 of the setting unit 1 if the two set values coincide with each other; a storage means M; a writing means W having an arrangement that, when the second response means R2 has discriminated that the two set values coincide with each other, it causes the set values or a processed result of the discrimination to be stored in the storage means M; a third response means R3 having an arrangement that, when the third command has been received from the third command means I3, it reads, from the storage means M, the set value specified in accordance with the third command and transmits the read set value to the fourth discrimination means D4 of the setting unit 1; and a fourth response means R4 having an arrangement that, when the fourth command has been received from the fourth command means 14, it reads, from the storage means M, the set value specified in accordance with the fourth command and transmits the read set value to the display means I[illegible] of the setting unit 1.

The first to fourth response means R1 to R4 are included in the MPU 21. (see FIG. 1) of the fire detector 20, while the storage means M corresponds to the EEPROM 25 and RAM 26 (see FIG. 1 ) of the fire detector 20. The writing means W is included in the MPU 21 (see FIG. 1 ) of the fire detector 20.

The fire detector 20 has address that is common to all terminal units, such as the fire detectors. The first to fourth command means I1 to I4 of the setting unit 1 are arranged to simultaneously transmit the common address. The first to fourth response means R1 to R4 of the fire detector 20 discriminate whether or not the commands and the set value or the commands and the common address have been received.

Figures 3A, 3B, 3C, 3D, 3E, 3F, 3G, 3H:
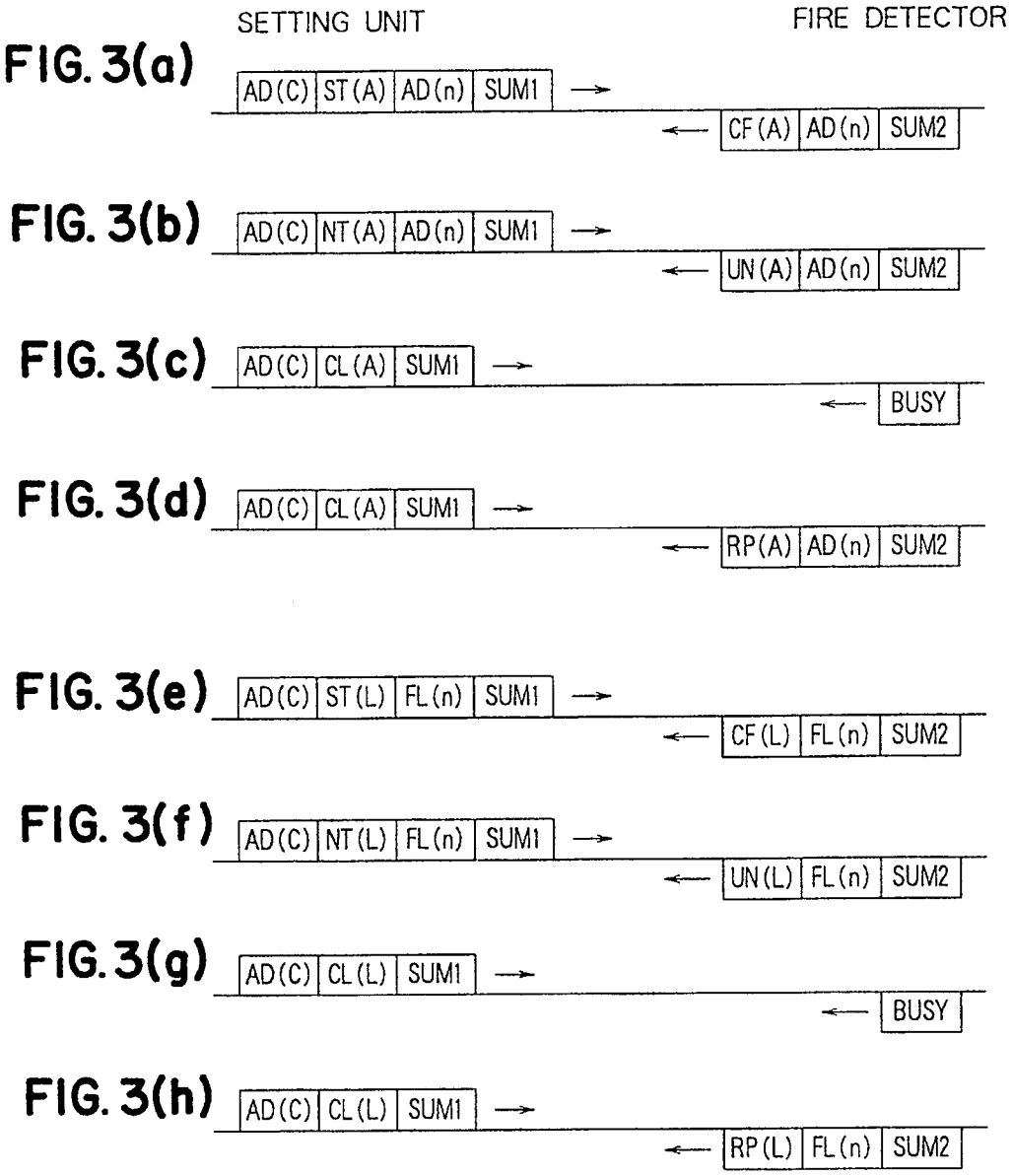
FIGS. 3(*a*)–3(*b*) illustrates an example of a transmission format for use at the time of the setting operation of the embodiment of the fire alarm system according to the present invention.

FIGS. 3(A)–3(*h*) illustrate an example of a transmission format, in which (a) to (d) of FIGS. 3(*a*)–3(*h*) illustrate a transmission format for use when the address is set and (e) to (h) of FIGS. 3(*a*)–3(*h*) illustrate a transmission format when the discrimination value is set.

Referring to FIGS. 3(*a*)–3(*h*), portions above the time axis show formats of transmission signals to be transmitted from the setting unit 1 to the fire detector 20. As shown in FIGS. 3(*a*)–3(*h*), the signals are sequentially transmitted from the left toward the right of the drawing. Portions below the time axis show formats of transmission signals to be transmitted from the fire detector 20 to the setting unit 1. As shown in FIGS. 3(*a*)–3(*h*), the signals are sequentially transmitted from the left toward the right of the drawing. In either case, the start code and the end codes are omitted from illustration.

Referring to FIGS. 3(*a*)–3(*h*), symbols AD (C) represent the common address, ST (A) represent an address setting start command, AD (n) represent the set address (self-address), CF (A) represent an address setting confirmation command, NT (A) represent an address setting notification command, UN (A) represent an address setting recognition signal, CL (A) represent an address requirement command, BUSY represent a busy signal and RP (A) represent an address response signal.

Symbols ST (L) represent a discrimination value setting start command, FL (n) represent a fire discrimination value (for example, smoke density of 10%/m, smoke density of 15%/m, 70° C., 80° C., type-1 of the rate of rise heat (2°–10° C./minute) or type-2 of the rete of rise heat (3°–15° C./minute), which is one of the set discrimination values, CF (L) represent a discrimination value setting confirmation signal, NT (L) represent a discrimination value setting notification command, UN (L) represent a discrimination value setting recognition signal, CL (L) represent a discrimination value requirement command and RP (L) represent a discrimination value response signal.

SUM1 is a primary sum check code for discriminating whether or not the fire detector 20 has accurately received a transmitted signal when the signal is transmitted from the setting unit 1 to the fire detector 20. In an example case where each of the AD (C), ST (A) and AD (n) shown in FIG. 3(*a*) is composed of 8-bit code signal, the foregoing codes are added and the lower eight bits of the result of the addition are used as a primary sum check code. The fire detector 20 adds the received codes AD (C), ST (A) and AD (n) and discriminates that it has accurately received the signal if the result of the addition coincides with the received SUM1.

SUM2 is a second sum check code for discriminating whether or not the setting unit 1 has accurately received a transmitted signal when the signal is transmitted from the fire detector 20 to the setting unit 1. For example, the codes AD (C), ST (A) and AD (n) received from the setting unit 1 and the codes CF (A) and AD (n) are added and the lower eight bits of the result of the addition are made to be a second sum check code. The setting unit 1 adds the transmitted codes AD (C), ST (A) and AD (n) and the received codes CF (A) and AD (n). If the result of the addition coincides with the SUM2, the setting unit 1 discriminates that the fire detector 20 has accurately received the signal from the setting Unit 1 and that the signal transmitted by the fire detector 20 has received accurately.

The operation of the embodiment shown in FIG. 1 will now be described with reference to FIGS. 4 to 9. The operations of checking the received signal by using the sum check code SUM1 or SUM2 are omitted from the description in order to simplify the description.

Figure 4:
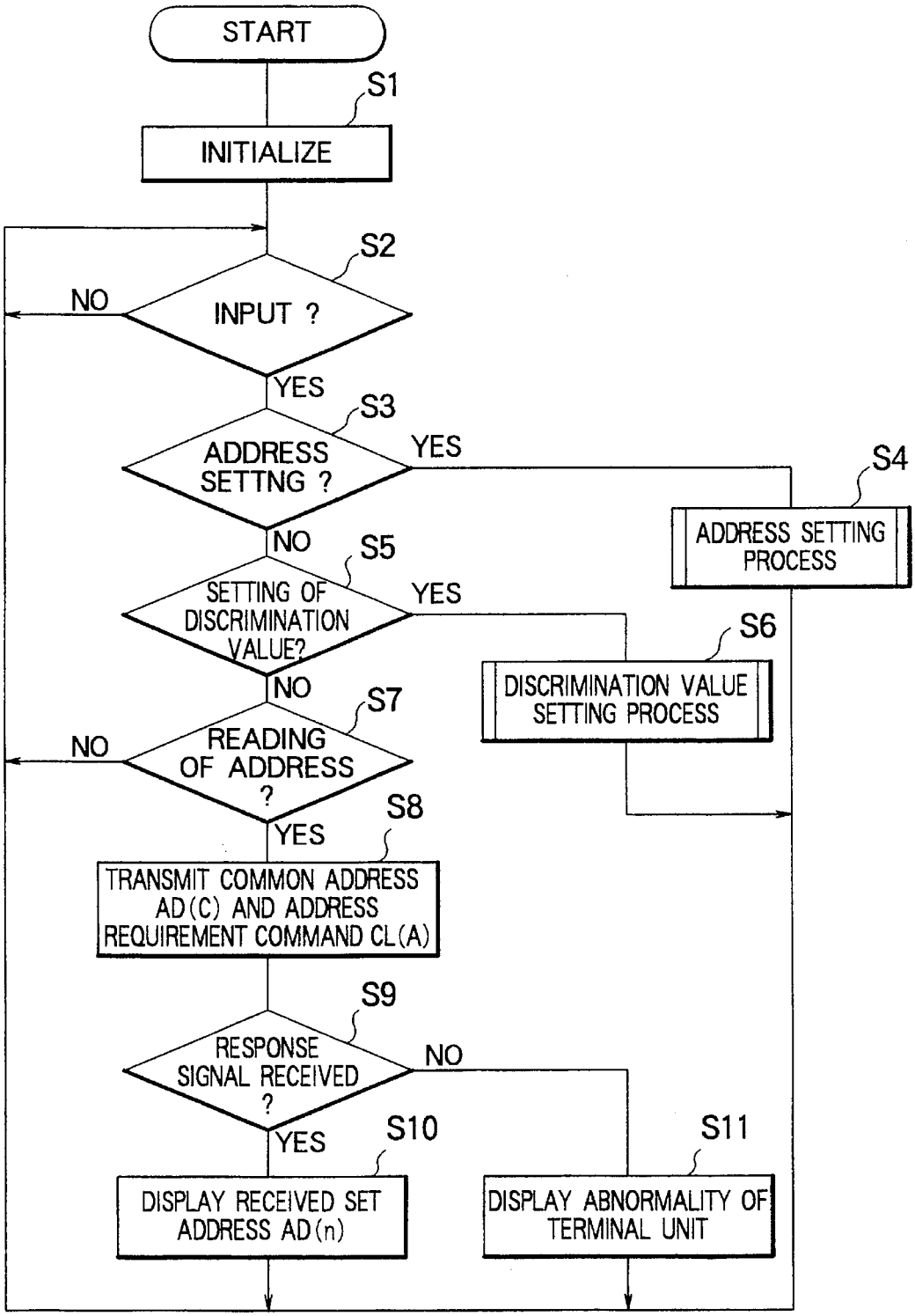
FIG. 4 is a flow chart for use to describe the operation of the setting unit shown in FIG. 1.
Figure 5:
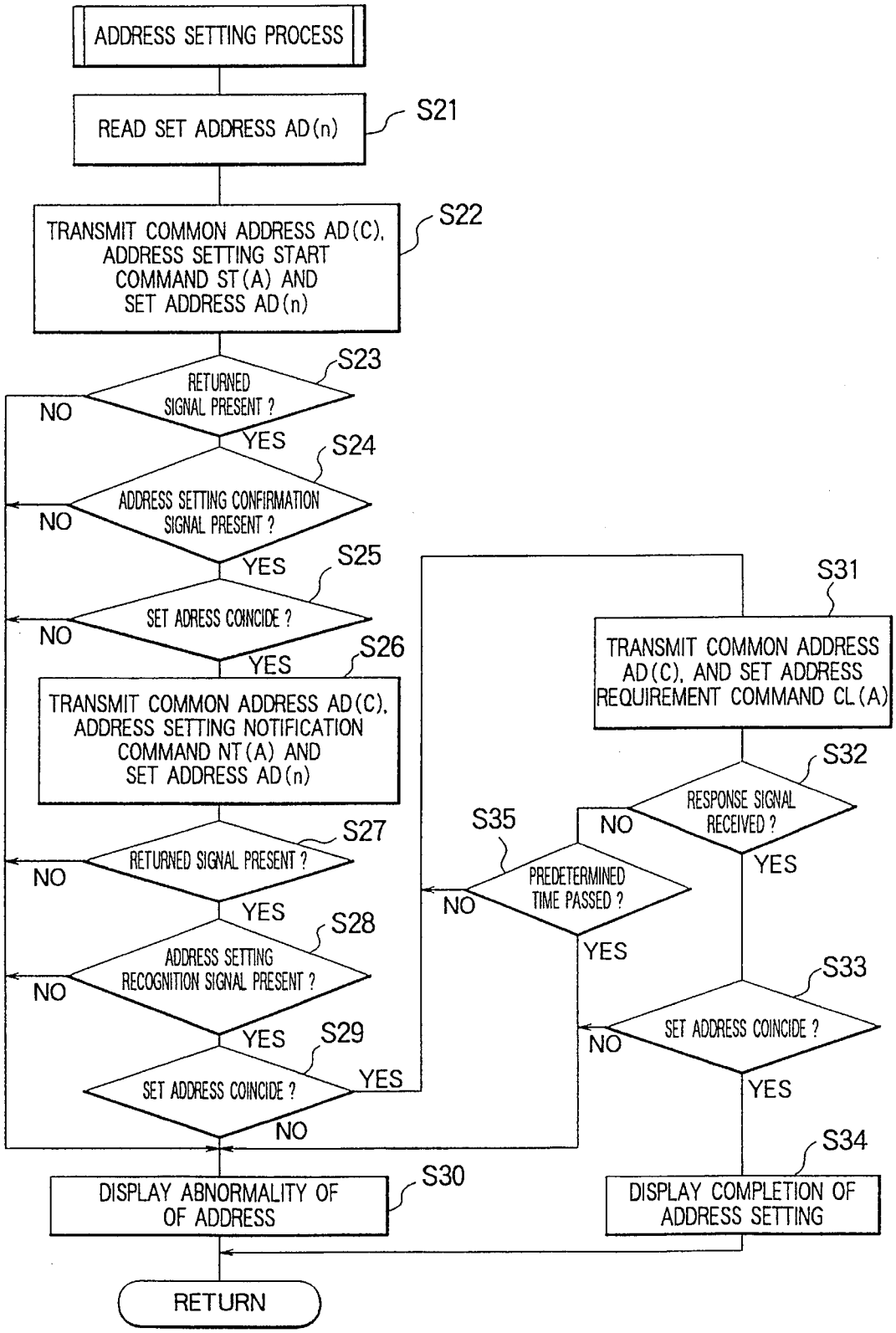
FIG. 5 is a flow chart for use to describe the operation of the setting unit shown in FIG. 1.
Figure 6:
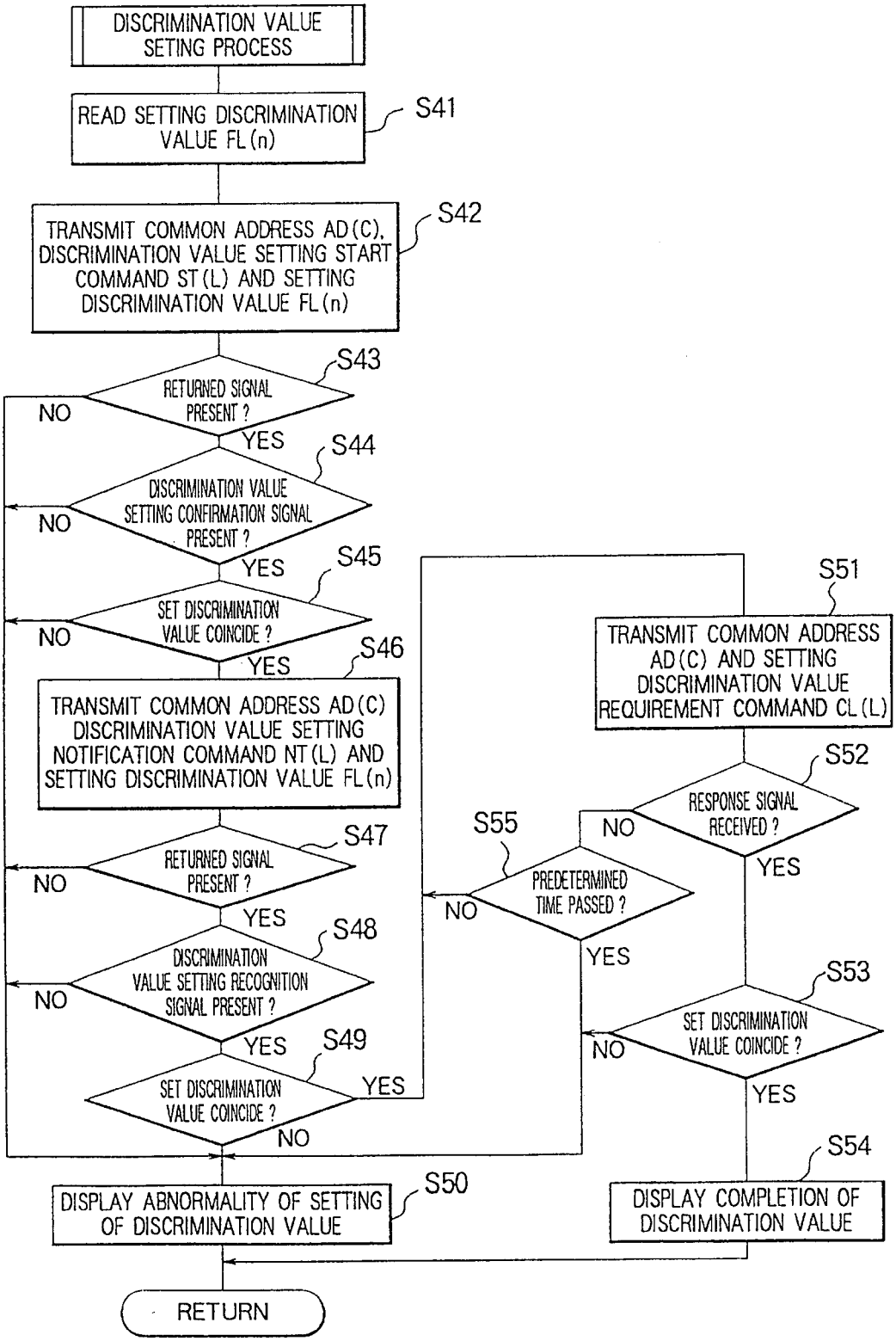
FIG. 6 is a flow chart for use to describe the operation of the setting unit shown in FIG. 1.

Initially, the operation of the setting unit 1 will now be described with reference to FIGS. 4 to 6. Note that all discrimination operations in the following operations are performed by the MPU 2.

In step S1, the RAM 6, IF's 8, 10, 12 and 14 and the like are initialized. In step S2 whether or not input from the input portion 7 has been made is discriminated. If no input has been made, input is waited for. If an input has been made, whether or not the input is address setting is discriminated in step S3. If it is the address setting, the operation proceeds to step S4 in which the address setting operation to be described later is performed.

If a discrimination has been made in step S3 that the input is not the address setting, whether or not the input is the setting of the discrimination value is discriminated in step S5. If it is the setting of the discrimination value, the flow proceeds to step S6 in which the process of setting the discrimination value to be described later is performed.

If a discrimination has been made in step S5 that the input is not the setting of the discrimination value, a discrimination is made in step S7 as to whether it is reading of the address. If it is not reading of the address, the flow returns to step S2 in which the foregoing operations are repeated. If it is reading of the address, the common address AD (C) and the address requirement command CL (A) are transmitted to the fire detector 20 in step S8.

In step S9 whether or not the response signal supplied by the fire detector 20 has been received within a predetermined time is discriminated. If it has been received as described above, the received set address AD (n) is displayed on the display portion 9 in step S10.

If the response signal from the fire detector 20 has not been received within the predetermined time in step S9, an abnormality of the fire detector 20, which is the terminal unit, is displayed on the display portion 9.

The address setting process to be performed in step S4 will now be described with reference to FIG. 5. In step S21 the set address AD (n) is read from the input portion 7. In step S22 the common address AD (C), the address setting start command ST (A) and the set address AD (n) are transmitted to the fire detector 20.

In step S23 whether or not a signal has been returned from the fire detector 20 within a predetermined time is discriminated. If the signal has been returned, whether or not the address setting confirmation signal CF (A) is present is discriminated in step S24. If it is present, whether or not the received set address coincides with the transmitted set address is discriminated in step S25. If they coincide with each other, the common address AD (C), the address setting notification command NT (A) and the set address AD (n) are transmitted to the fire detector 20 in step S26.

In step S27 whether or not a return signal from the fire detector 20 is present is discriminated. If it is present, whether or not the address setting recognition signal UN (A) is present is discriminated in step S28. If it is present, the set address coincides is discriminated in step S29. If they do not coincide with each other, the fact that the address setting encounters abnormality is displayed on the display portion 9 in step S30.

If negative discrimination results are obtained in steps S23, S24, S25, S27 and S28, the flow proceeds to step S30 in which the fact that address setting encounters abnormality is displayed on the display portion 9.

If the set addresses coincide with each other in step S29, the common address AD (C) and the address requirement command CL (A) are transmitted to the fire detector 20 in step S31.

In step S32 whether or not a response signal from the fire detector 20 has been received is discriminated. If it has been received, whether or not the received set address coincides with the set address transmitted in step S22 or step S26 is discriminated in step S33. If they coincide with each other, the completion of address setting is displayed on the display portion 9 in step S34.

If the response signal has not been received in step S32, whether or not a predetermined time required to performing writing on the EEPROM 25 has passed is discriminated in step S35. If the predetermined time has not passed, the flow returns to step S31 in which the foregoing operations are repeated. If the predetermined time has passed, the flow returns to step S30 in which the fact that address setting has encountered abnormality is displayed on the display portion 9. Also in the case where the set addresses do not coincide with each other in step S33, the flow returns to step S30 in which the fact that address setting has encountered abnormality is displayed on the display portion 9.

If the set addresses coincide with each other in step S29, the flow may be returned to step S8 (see FIG. 4) while skipping steps S31 to S35.

The discrimination value setting process to be performed in step S6 will now be described with reference to FIG. 6.

In step S41 the setting discrimination value FL (n) is read from the input portion 7. In step S42 the common address AD (C), the discrimination value setting start command ST (L) and the setting discrimination value FL (n) are transmitted to the fire detector 20.

In step S43 whether or not a signal has been returned from the fire detector 20 within a predetermined time is discriminated. If the signal has been returned, whether or not the discrimination value setting confirmation signal CF (L) is present is discriminated in step S44. If it is present, whether or not the received setting discrimination value coincides with the set discrimination value is discriminated in step S45. If they coincide with each other, the common address AD (C), the discrimination value setting notification command NT (L) and the setting discrimination value FL (n) are transmitted in step S46.

In step S47 whether or not a signal has been returned from the fire detector 20 is discriminated. If the signal has been returned, whether or not the discrimination value setting recognition signal UN (L) is present is discriminated in step S48. If it is present, whether or not the received setting discrimination value coincides with the setting discrimination value FL (n) is discriminated in step S49. If they do not coincide with each other, the fact that the setting of the discrimination value encounters abnormality is displayed on the display portion 9 in step S50.

If negative discrimination results are obtained in steps S43, S44, S45, S47 and S48, the operation proceeds to step S50 in which the fact that setting of the discrimination value encounters abnormality is displayed on the display portion 9.

If the setting discrimination values coincide with each other in step S49, the common address AD (C) and the address requirement command CL (A) are transmitted to the fire detector 20 in step S51.

In step S52 whether or not the response signal from the fire detector 20 has been received is discriminated. If it has been received, whether or not the received setting discrimination value coincides with the setting discrimination value transmitted in step S42 or step S46 is discriminated in step S53. If they coincide with each other, completion of setting of the discrimination value is displayed on the display portion 9 in step S54.

If no response signal has been received in step S52, whether or not a predetermined time required to write the setting discrimination value FL (n) on the EEPROM 25 has passed is discriminated in step S55. If the predetermined time has not passed, the flow returns to step S51 in which the foregoing operations are repeated. If the predetermined time has passed, the flow returns to step S50 in which a fact that setting of the discrimination value has encountered abnormality is displayed on the display portion 9. Also in the case where the setting discrimination values do not coincide with each other in step S53, the flow returns to step S50 in which the fact that setting of the discrimination value has encountered abnormality is displayed on the display portion 9.

Figure 7:
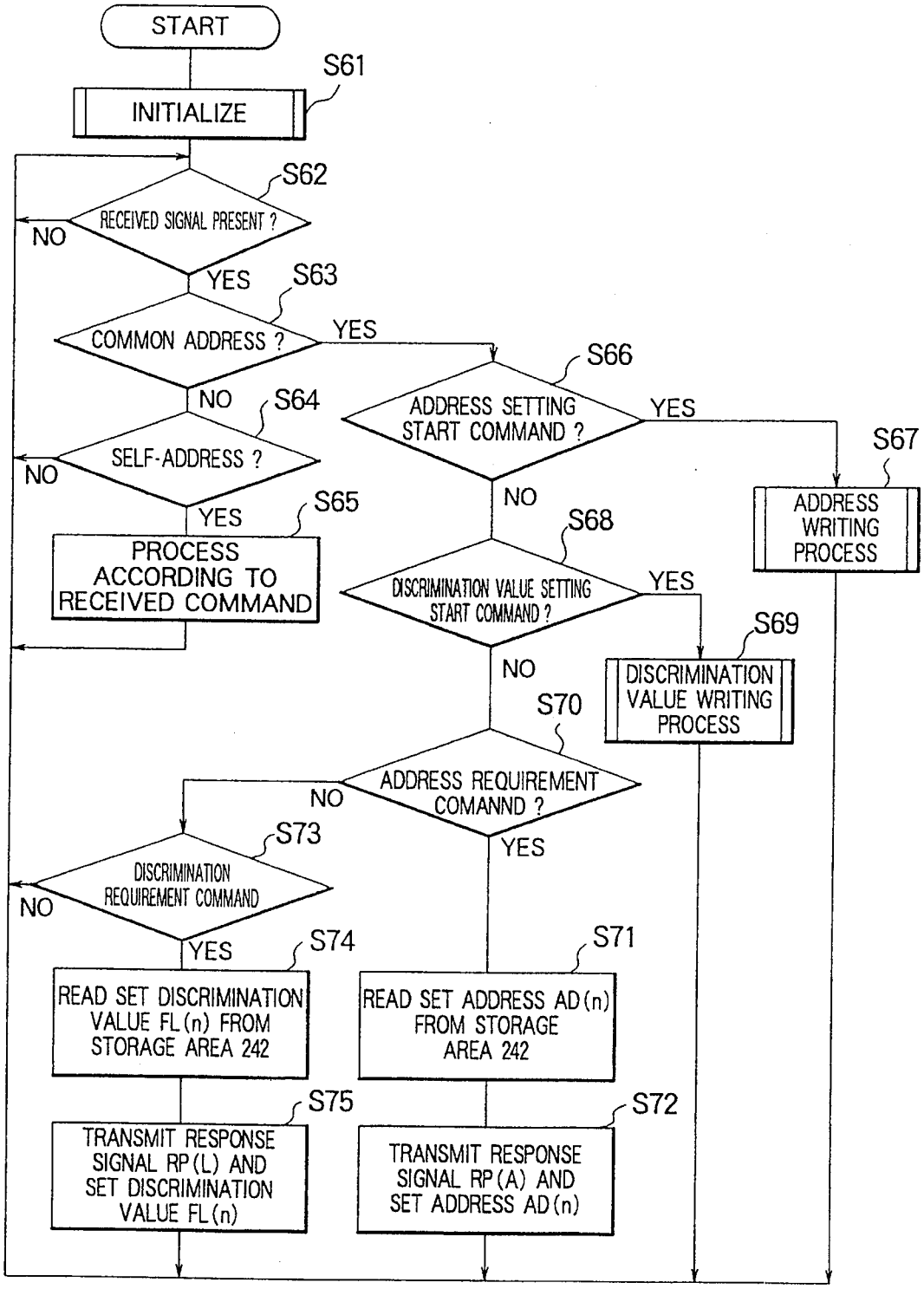
FIG. 7 is a flow chart for use to describe the operation of the terminal unit shown in FIG. 1.
Figure 8:
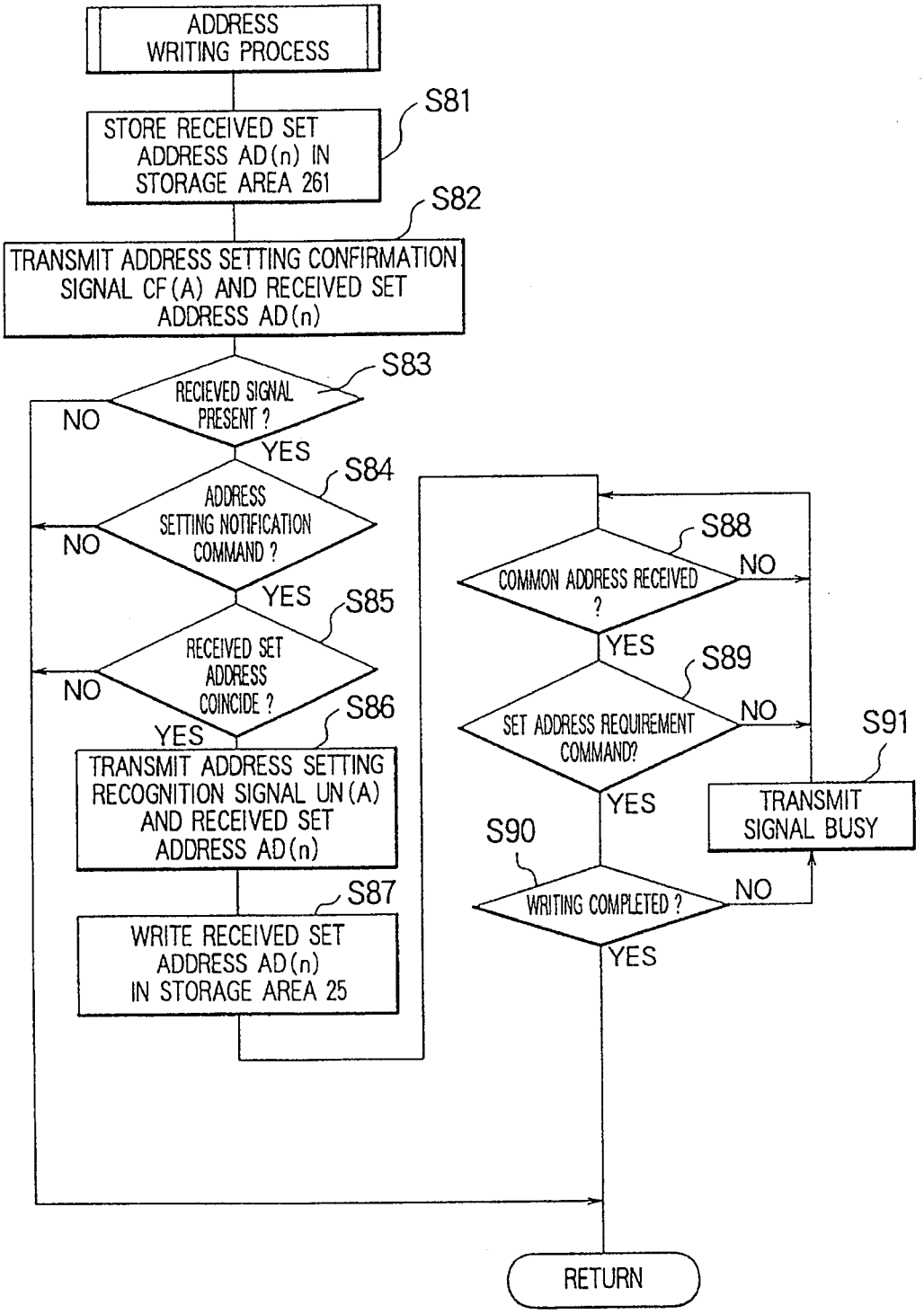
FIG. 8 is a flow chart for use to describe the operation of the terminal unit shown in FIG. 1.
Figure 9:
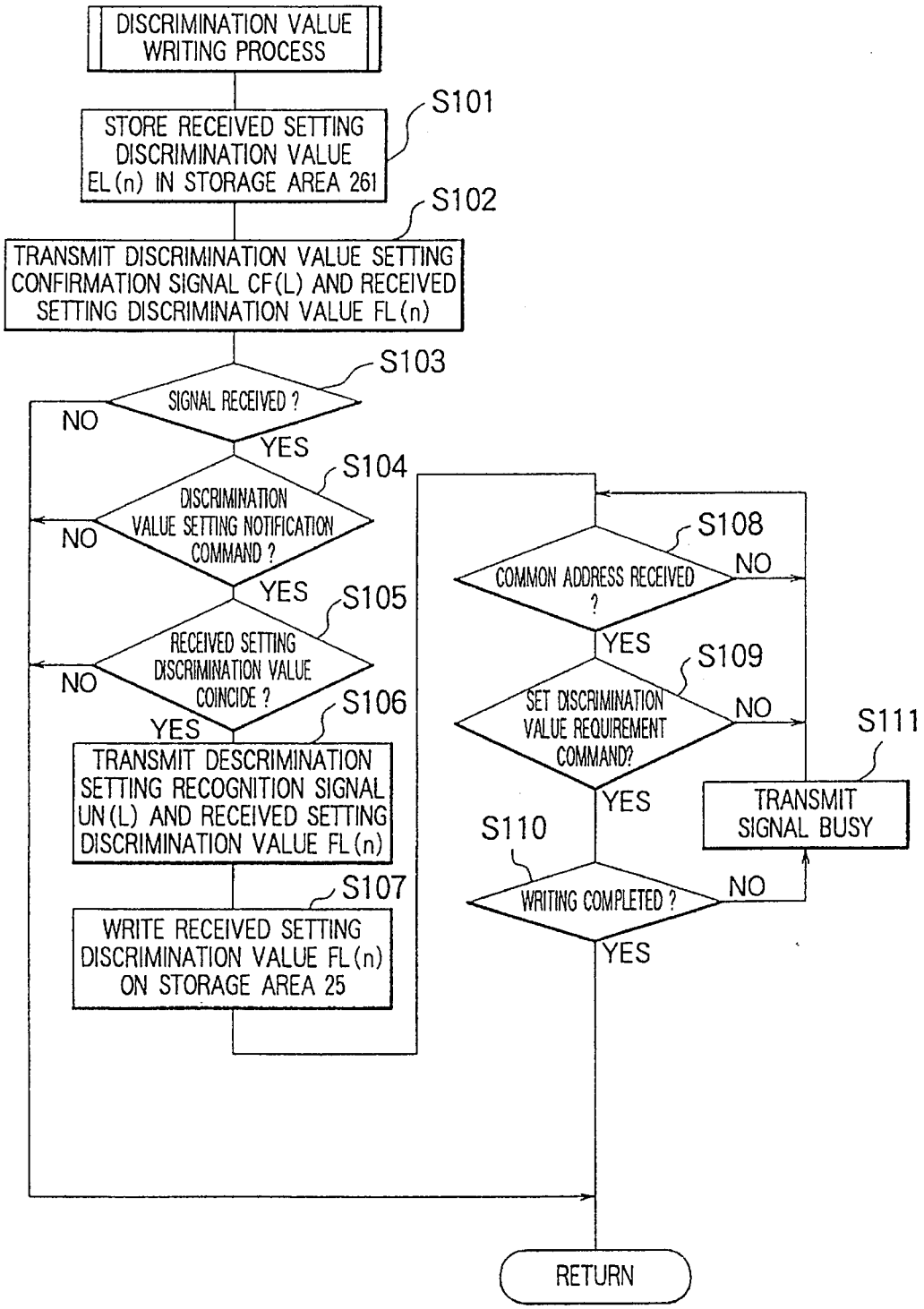
FIG. 9 is a flow chart for use to describe the operation of the terminal unit shown in FIG. 1.

The operation of the fire detector 20 will now be described with reference to FIGS. 7 to 9. Note that all discrimination operations are performed by the MPU 21.

In step S61 the RAM 26, the IF's 28, 30 and 32 and the like are initialized. In step S62 whether or not a signal from the setting unit 1 or a receiving portion (not shown) of the fire receiver or the like has been received is discriminated. If no signal has been received, the signal receipt is waited for. If a signal has been received, whether or not the common address is included in the received signal is discriminated in step S63. If it is not included, whether or not the self-address is included in the received signal is discriminated in step S64. If it is not included, the flow returns to step S62 in which the foregoing operations are repeated. If it is included, a process according to the received command is performed in step S65. That is, if the received command is, for example, the fire information requirement command, presence/absence of a fire signal discriminated by the fire detection portion 29 in accordance with the output denoting detection of a fire phenomenon or fire information of the physical quantity (for example, an analog level) of a fire phenomenon in accordance with the output denoting detection of a fire phenomenon is transmitted. Then, the flow returns to step S62 in which the foregoing operations are performed.

If the common address is included in step S63, a discrimination is made in step S66 whether or not it is the address setting start command ST (A). If it is the address setting start command ST (A), the flow proceeds to step S67 in which a process of writing address is performed as described later.

If a discrimination is made in step S66 that it is not the address setting start command ST (A), whether or not it is the discrimination value setting start command ST (L) is discriminated in step S68. If it is the discrimination value setting start command ST (L), the flow proceeds to step S69 in which a process of writing a discrimination value is performed as described later.

If a discrimination has been made in step S68 that it is not the discrimination value setting start command ST (L), whether or not it is the address requirement command CL (A) is discriminated in step S70. If it is the address requirement command CL (A), the set address AD (n) is read from the address storage area of the EEPROM 25 in step S71. In step S72 the response signal RP (A) and the set address AD (n) are transmitted to the setting unit 1. Then, the flow returns to step S62 in which the foregoing operations are performed.

If it is not the address requirement command CL (A) in step S70, whether or not it is the setting discrimination value requirement command CL (L) is discriminated in step S73. If it is not the setting discrimination value requirement command CL (L), the flow returns to step S62 in which the foregoing operations are repeated. If it is the setting discrimination value requirement command CL (L), the setting discrimination value FL (n) is read from the discrimination value storage area of the EEPROM 25 in step S74. In step S75 the response signal RP (L) and the set address AD (n) are transmitted to the setting unit 1. Then, the flow returns to step S62 in which the foregoing operations are repeated.

The address writing process to be performed in step S67 will now be described with reference to FIG. 8.

In step S81 the set address AD (n) is stored in the storage area 261 of the RAM 26. In step S82 the address setting confirmation signal CF (A) and the received set address AD (n) are transmitted to the setting unit 1.

In step S83 whether or not a signal has been received from the setting unit 1 within a predetermined time is discriminated. If a signal has been received, whether or not it is the address setting notification command NT (A)is discriminated in step S84. If it is the address setting notification command NT (A), whether or not the received set address coincides with the set address AD (n) received in step S81 is discriminated in step S85. If they coincide with each other, the address setting recognition signal UN (A) and the set address AD (n) are transmitted to the setting unit 1 in step S86.

In step S87 the received set address AD (n) is written on the address storage area of the EEPROM 25.

In step S88 whether or not the common address has been received is discriminated. If it has not been received, receipt of it is waited for. If it has been received, whether or not it is the address requirement command CL (A) is discriminated in step S89. If it is not the address requirement command CL (A), the flow returns to step S88 in which the foregoing operations are repeated. If it is the address requirement command CL (A), whether or not writing has been completed is discriminated in step S90. If it has not been completed, the signal BUSY representing that the writing operation is being performed is transmitted to the setting unit 1 in step S91. If it has been completed, the flow returns to step S62. Since the common address AD (C) and the address requirement command CL (A) are received, the processes in steps S71 and S72 are performed. Then, the set address AD (n) read from the EEPROM 25 is transmitted to the setting unit 1.

The discrimination value writing process to be performed in step S69 will now be described with reference to FIG. 9.

In step S101 the received setting discrimination value FL (n) is stored in the storage area 261 of the RAM 26. In step S102 the discrimination value setting confirmation signal CF (L) and the received setting discrimination value FL (n) are transmitted to the setting unit 1.

In step S103 whether or not a signal has been received from the setting unit 1 within a predetermined time is discriminated. If a signal has been received, whether or not the discrimination value setting notification command NT (L) is present is discriminated in step S104. If it is present, whether or not the received setting discrimination value coincides with the setting discrimination value FL (n) received in step S101 is discriminated in step S105. If they coincide with each other, the discrimination value setting recognition signal UN (L) and the received setting discrimination value FL (n) are transmitted to the setting unit 1.

In step S107, the received setting discrimination value FL (n) is written on a discrimination value storage area of the EEPROM 25.

In step S108, whether or not the common address has been received is discriminated. If it has not been received, receipt of it is waited for. If it has been received, whether or not it is the setting discrimination value requirement command CL (L) is discriminated in step S109. If it is not the setting discrimination value requirement command CL (L), the flow returns to step S108 in which the foregoing operations are repeated. If it is the setting discrimination value requirement command CL (L), whether or not writing has been completed is discriminated in step S110. If it has not been completed, the signal BUSY is transmitted to the setting unit 1 in step S111. If it has been completed, the flow returns to step S62. Since the common address AD (C) and the setting discrimination value requirement command CL (L) are received, the processes in steps S74 and S75 are performed. Then, the setting discrimination value FL (n) read from the EEPROM 25 is transmitted to the setting unit 1.

As described above, this embodiment has the arrangement that, when the set value for the terminal unit is changed or adjusted, the adjustment code different from the usual code for use in the fire supervisory operation or when a fire has taken place is used. Furthermore, a so-called plural collation method is employed in such a manner that the upper code value in the plural collation is made to be different for each process. In addition, the lower code value is made to be different to correspond to the number of collations in the predetermined process. Therefore, address and various discrimination values of the fire detector, which is one of terminal units of the fire alarm system, can easily and assuredly be set.

Furthermore, undesirable change in the set data, such as the address of the fire detector and the various discrimination values, can be prevented which undergoes due to polling from the receiving portion when the fire detector is connected to the receiving portion of a fire receiver or the like and the fire detector is being operated normally. Furthermore, set data of the fire detector cannot be changed by tampering. Moreover, even if the address of the fire detector is unknown, data set to the fire detector is read so that the content of the set data is known. In addition, the set value can accurately be confirmed and erroneous recognition in the system can be prevented. Since the confirmation can be performed sufficiently, erroneous adjustment can be prevented and thus the reliability can be improved.

Even if the address of the terminal unit is unknown, data set to the terminal unit is read so that the content of the set data is known. The common address enables setting of address of each terminal unit and various discrimination values to be performed easily and assuredly.

Although the foregoing embodiment has the arrangement that the set address (the self-address when viewed from the fire detector) and the set discrimination value are fire discrimination values, the arrangement is not limited to this. They may be other setting discrimination values, for example, a threshold for discriminating a trouble, a threshold for testing, set time for a timer (for example, time for control), a reference value for calculating an analog level and the like. In this case, codes given to the commands shown in FIGS. 3 to 9 are changed as follows:

| | For discriminating trouble (false alarm) | For testing | Set time |
|---|---|---|---|
| Setting start command | ST (F) | ST (TE) | ST (TM) |
| Set value | FA (n) | TE (n) | TM (n) |
| Setting confirmation signal | CF (F) | CF (TE) | CF (TM) |
| Setting notification command | NT (F) | NT (TE) | NT (TM) |
| Setting recognition signal | UN (F) | UN (TE) | UN (TM) |
| Requirement command | CL (F) | CL (TE) | CL (TM) |

Although the foregoing embodiment has been described about the structure in which the fire detector is used as an example of the terminal unit of the fire alarm system, the present invention is not limited to this. Another terminal unit, for example, a transmitter or a manual box, may be used. If the terminal unit is a supervising transmitter, a receiving circuit for receiving a fire signal transmitted by the fire detector 20 or a physical quantity signal of the fire phenomenon is required to be provided in place of the fire detection portion 29. If it is a transmitter for control, a control circuit for transmitting electric power or a control signal to a unit to be controlled, such as a fire block door, a smoke preventing and exhausting unit or a fire extinguishing unit, and for supervising the state (for example, an opened state or a closed state) of the unit to be controlled is required to be provided in place of the fire detection portion 29. In place of the testing portion 31, a wire break monitoring circuit is required to be provided which monitors presence/absence of wire breakage of the signal and power supply line or the control line extending from the control circuit to the unit to be controlled. If the terminal unit is a manual box, a push button is required to be provided in place of the fire detection portion 29. In each case, an effect obtainable from the foregoing embodiment can be obtained.

Although the foregoing embodiment has the arrangement that reading of the output representing the result of the detection performed by the fire detection portion 29 is performed by the coincidence of the addresses, reading may be performed by using the included timer.

Another embodiment of the present invention will now be described with reference to the drawings, in which a fire detector is used as the terminal unit to which setting is made.

Figure 10:
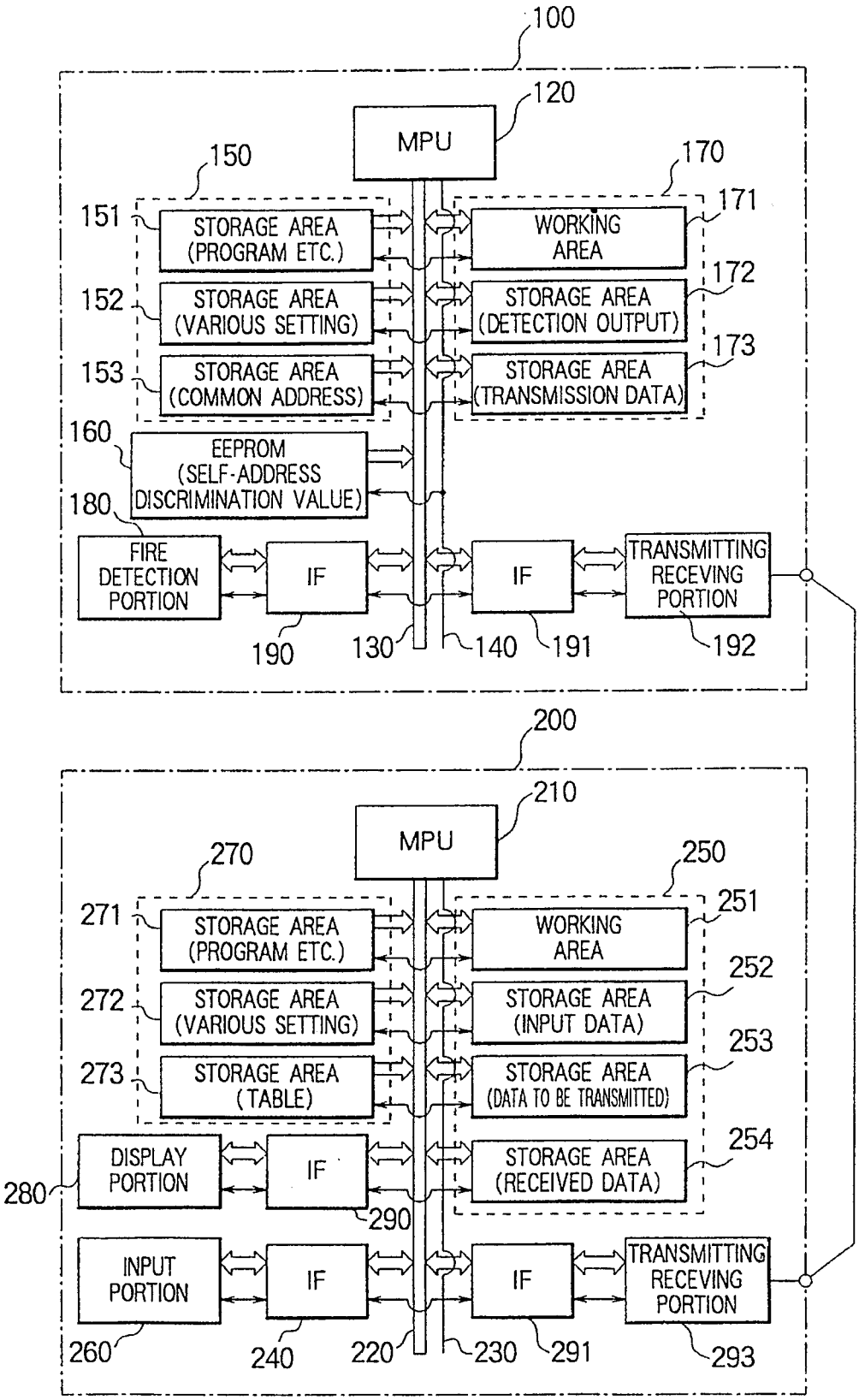
FIG. 10 is a block diagram which illustrates another embodiment of the fire alarm system according to the present invention.

FIG. 10 is a block diagram which illustrates the other embodiment of the present invention.

Referring to FIG. 10, the terminal unit, for example, a fire detector 100 comprises: a microprocessor unit (hereinafter called an "MPU") 120 serving as a calculating means for performing a variety of calculating processes to be described later; a data bus 130 and a control bus 140 respectively connected to the MPU 120; and a read only memory (hereinafter called a "ROM") 150 serving as a storage means connected to the MPU 120 through the data bus 130 and the control bus 140. The ROM 150 has a storage area 151 in which a program relating to a flow chart to be described later and shown in FIG. 12 and the like are previously stored, and a storage area 152 in which various constants are previously stored, and a storage area 153 in which a common address common to all terminal units is previously stored.

The fire detector 100 comprises: an EEPROM 160, which is an electrically write and erasure enabled, that is, a rewriting enabled non-volatile memory which is connected to the MPU 120 through the data bus 130 and the control bus 140 and in which self-address, which is the address to be set, and a fire discrimination value serving as an example of the set discrimination value are stored; and a random access memory (hereinafter called a "RAM") 170 serving as a storage means connected to the MPU 120 through the data bus 130 and the control bus 140. As an alternative to use of the EEPROM 160, a RAM with a backup power source or the like may be used. The RAM 170 comprises a storage area 171 for use in a case where the MPU 120 performs the calculating operation, a storage area 172 for updating and storing output denoting the detected fire phenomenon for latest several outputs (for example, three times per three seconds) and a storage area 173 in which data to be transmitted (for example, an output denoting the result of the detection, self-address, a threshold for discriminating a fire, results of the test and the like) is stored.

The fire detector 100 comprises an interface (hereinafter called an "IF") 190, a fire detection portion 180 connected to the MPU 120 through the data bus 130 and the control bus 140 and arranged to detect the fire phenomenon, such as heat, smoke, flame, gas or smell to output the physical quantity and a transmitting/receiving portion 192 connected to the MPU 120 through an IF 191, the data bus 130 and the control bus 140 and composed of a parallel/series conversion circuit, a transmitting circuit, a receiving circuit, a series/parallel conversion circuit and the like (not shown) in order to transmit/receive information to and from a setting unit to be described later. In a case where the fire detection portion 180 is, for example, a heat detector, it comprises a heat sensitive device, such as a thermistor and an A/D conversion circuit. In a case where it is a photoelectric type or a light obscuration type smoke detector, it comprises a light emission control circuit, a light emitting device, a light receiving device, an amplifying circuit, a sample and hold circuit, an A/D conversion circuit and the like. In a case where it is an inonization type smoke detector, it comprises an external ion chamber, an internal ion chamber, an FET, an A/D conversion circuit and the like. If it is a flame detector, it comprises a detection device, such as a pyroelectric device or an ultraviolet-ray detection device, an amplifying circuit, an A/D conversion circuit and the like. In a case where it is a gas-type or a smell-type detector, it comprises a gas detection device or a smell detection device, an A/D conversion circuit and the like. The transmitting/receiving circuit 192 transmits/receives information to and from the fire receiver and the like in a case where it is connected to the fire receiver or the like.

Figure 15:
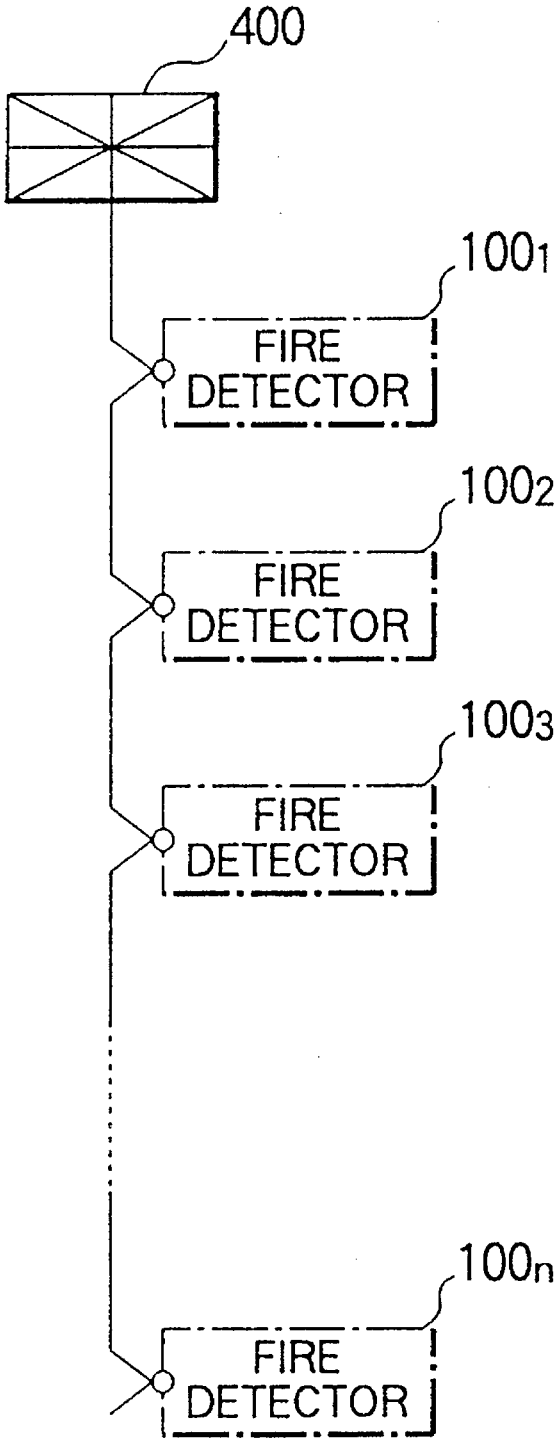
FIG. 15 is a flow chart for use to describe the operation of the terminal unit shown in FIG. 10.

Note that the fire detector 100 is usually composed of a plurality of fire detector 1001 to 100*n* connected to the fire receiver 400 as shown in FIG. 15.

A setting unit 200 is used to set data for setting addresses and various discrimination values (for example, a threshold for discriminating a fire, a threshold for discriminating a trouble, a threshold for testing a false alarm and a miss alarm, the accumulation time and timer set time for control or the like) to a fire alarm system including fire detectors, manual boxes, transmitters and the like or a fire extinguishing system, the setting being performed at a manufacturing plant or the spot at which the system is terminal unit is installed. The setting unit 200 may be an exclusive unit or a personal computer.

The setting unit 200 comprises an MPU 210 serving as a calculating means for performing calculating various operations to be described later, a data bus 220 and a control bus 230 respectively connected to the MPU 210, and a ROM 270 serving as a storage means connected to the MPU 210 through the data bus 220 and the control bus 230. The ROM 270 includes a storage area 271 in which a program or the like relating to a flow chart shown in FIGS. 13 and 14 and to be described later is previously stored, a storage area 272 in which a variety of constants are previously stored, and a storage area 273 in which collation tables between input data and output data, between input or received data and displayed data and the like are previously stored.

The setting unit 200 comprises: a RAM 250 connected to the MPU 210 through the data bus 220 and the control bus 230; an input portion 260, for example, a keyboard, connected to the MPU 210 through an IF 240, the data bus 220 and the control bus 230; a display portion 280, such as a liquid crystal panel, a CRT, a count display tube or a display lamp, connected to the MPU 210 through an IF 290, the data bus 220 and the control bus 230; and a transmitting/receiving circuit 293 connected to the MPU 210 through an IF 291, the data bus 220 and the control bus 230 and composed of a parallel/series conversion circuit, a transmitting circuit, a receiving circuit and a series/parallel conversion circuit (not shown) in order to transmit/receive information to and from the fire detector 100.

The setting unit 200 comprises a RAM 250 serving as a storage means connected to the MPU 210 through the data bus 220 and the control bus 230, a storage area 251 for use when the MPU 210 performs the calculating operation or the like, a storage area 252 for temporarily storing input data (for example, an address, a discrimination value of fire discrimination threshold and the like), a storage area 253 for temporarily storing data to be transmitted (for example, the common address, the address setting command, a fire threshold setting command, the set address, a fire threshold for setting and the like), and a storage area 254 for temporarily storing received data (for example, set (self) address).

Figure 11A:
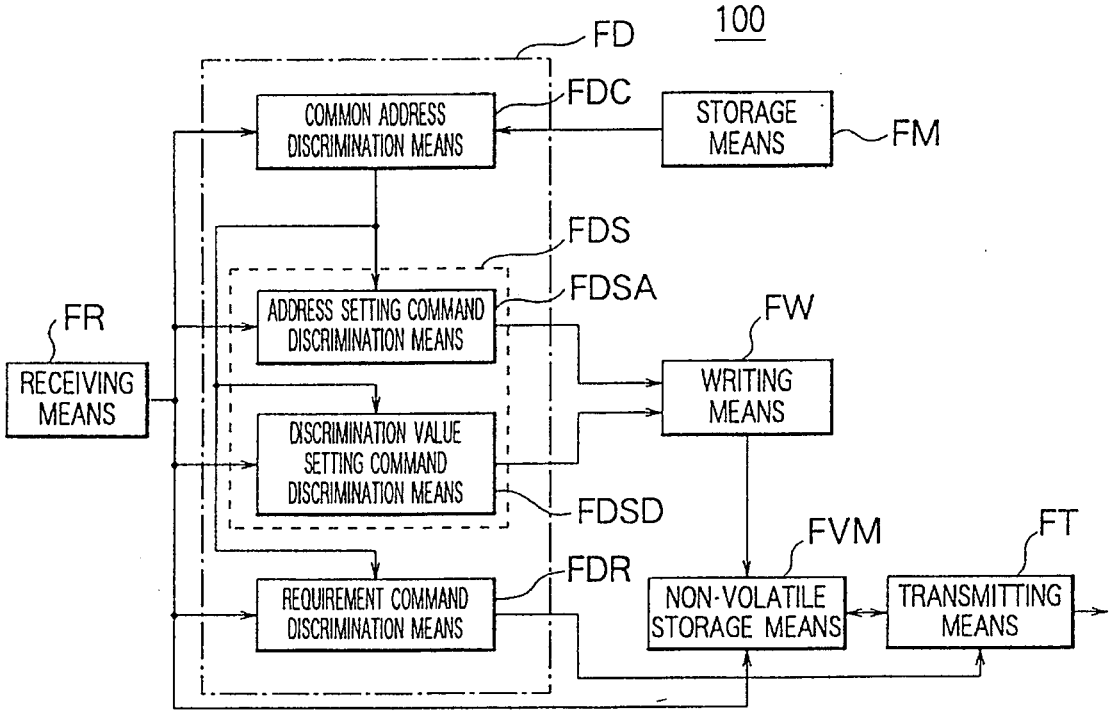
FIGS. 11(*a*) and 11(*b*) are a functional block diagram which illustrates the other embodiment of the present invention.
Figure 11B:
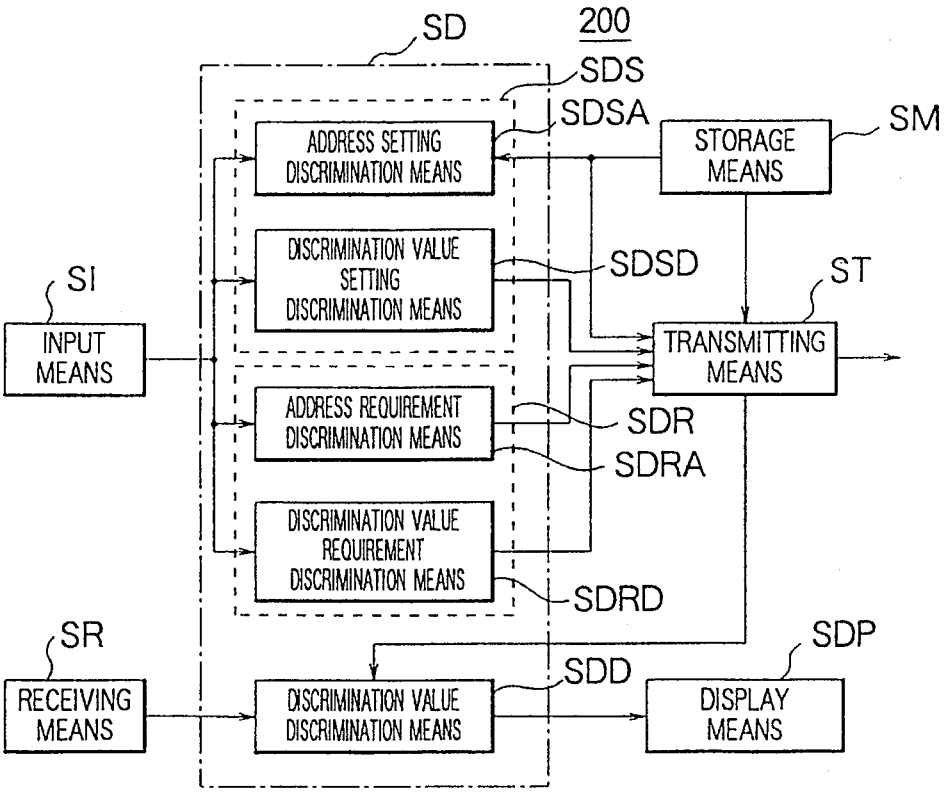

FIGS. 11(*a*)and 11(*b*) are a block diagram which illustrates the function of the other embodiment of the present invention. Portion (a) of FIG. 11 illustrates the portion including the fire detector 100, while portion (b) illustrates the portion including the setting unit 200.

Referring to FIGS. 11(*a*) and 11(*b*), the fire detector 100 comprises: a receiving means FR for receiving information transmitted by the setting unit 200; a storage means FM for storing common address common to the fire detectors 100 that are at least plural terminal units; an electrically write-enabled non-volatile storage means FVM in which the address and a variety of discrimination values (for example, a threshold for discriminating a fire, a threshold for discriminating a trouble, a testing threshold when an false alarm or a miss alarm takes place, the accumulation time, timer set time and the like) are stored; a discrimination means FD for discriminating information transmitted by the setting unit 200 through the receiving means FR; a writing means FW having an arrangement that, when the address setting command has been received after the receipt of the common address, it stores the received set address in the non-volatile storage means FVM as the self-address, the writing means FW having an arrangement that, when the setting discrimination value has been received, it stores the received setting discrimination value in the non-volatile storage means FVM; and a transmitting means FT having an arrangement that, when the requirement command has been received after the receipt of the common address, it reads a discrimination value corresponding to the requirement command from the non-volatile storage means FVM and transmits it to the setting unit 200. The discrimination means FD has a common address discrimination means FDC, a setting command discrimination means FDS and a requirement command discrimination means FDR.

The common address discrimination means FDC makes a reference to a storage means FM in accordance with an output from the receiving means FR to discriminate whether or not the common address has been received.

The setting command discrimination means FDS discriminates whether or not the setting command has been received together with the common address in accordance with an output from the receiving means FR when the common address discrimination means FDC has discriminated that the common address has been received. The setting command discrimination means FDS comprises an address setting command discrimination means FDSA and a discrimination value setting command discrimination means FDSD.

The address setting command discrimination means FDSA discriminates whether or not the received setting command is an address setting command when the common address discrimination means FDC has discriminated that the common address has been received. The discrimination value setting command discrimination means FDSD discriminates whether or not the received setting command is the discrimination value setting command when the common address discrimination means FDC has received the common address.

The requirement command discrimination means FDR discriminates whether or not the discrimination value requirement command has been received together with the common address in accordance with an output from the receiving means FR when the common address discrimination means FDC has discriminated that the common address has been received.

The setting unit 200 comprises: an input means SI for inputting a variety of discrimination values and required set values; a receiving means SR for receiving information transmitted from the fire detector 100; a discrimination means SD for discriminating the contents of the input from the input means SI and the output from the receiving means SR; a storage means SM; a transmitting means ST for making a reference to the storage means SM in accordance with an output from the discrimination means SD to transmit the common address, the setting command, the set value and the requirement command to the fire detector 100; and a display means SDP for displaying the result of discrimination performed by the discrimination value discrimination means SDD.

The discrimination means SD has a setting discrimination means SDS for discriminating whether or not the input from the input means SI is setting of the address or the discrimination value, a requirement discrimination means SDR for discriminating whether or not the input from the input means SI requires the fire detector 100 to return the address or the discrimination value, and a discrimination value discrimination means SDD for discriminating whether or not the discrimination value returned from the fire detector 100 and the discrimination value inputted from the input means SI coincide with each other.

The setting discrimination means SDS has an address setting discrimination means SDSA for discriminating whether or not the input from the input means SI is setting of the address and a discrimination value setting discrimination means SDSD for discriminating whether or not the input from the input means SI is setting of the discrimination value. The requirement discrimination means SDR has an address requirement discrimination means SDRA for discriminating whether or not the input from the input means SI requires the fire detector 100 to return the address and a discrimination value requirement discrimination means SDRD for discriminating whether or not the input from the input means SI requires the fire detector 100 to return the discrimination value.

The discrimination means FD is included in the MPU 120 (see FIG. 10) of the fire detector 100, the storage means FM is included in the ROM 150 (see FIG. 10) of the fire detector 100, the non-volatile storage means FVM corresponds to the EEPROM 60 (see FIG. 10) of the fire detector 100, the receiving means FR and the transmission means FT correspond to the transmitting/receiving portion 192 of the fire detector 100, and the writing means FW is included in the MPU 120.

The input means SI corresponds to the input portion 260 of the setting unit 200, the discrimination means SD is included in the MPU 210 (see FIG. 10) of the setting unit 200, the storage means SM corresponds to the ROM 270 (see FIG. 10) of the setting unit 200, the receiving means SR and the transmission means ST correspond to the transmitting/receiving portion 293 of the setting unit 200 and the display means SDP corresponds to the display portion 280 of the setting unit 200.

The operation of the other embodiment of the present invention shown in FIG. 10 will now be described with reference to FIGS. 12 to 15. Note that checking of the response signal to be performed by using the sum check code is omitted from the description in order to simplify the description.

Figure 12:
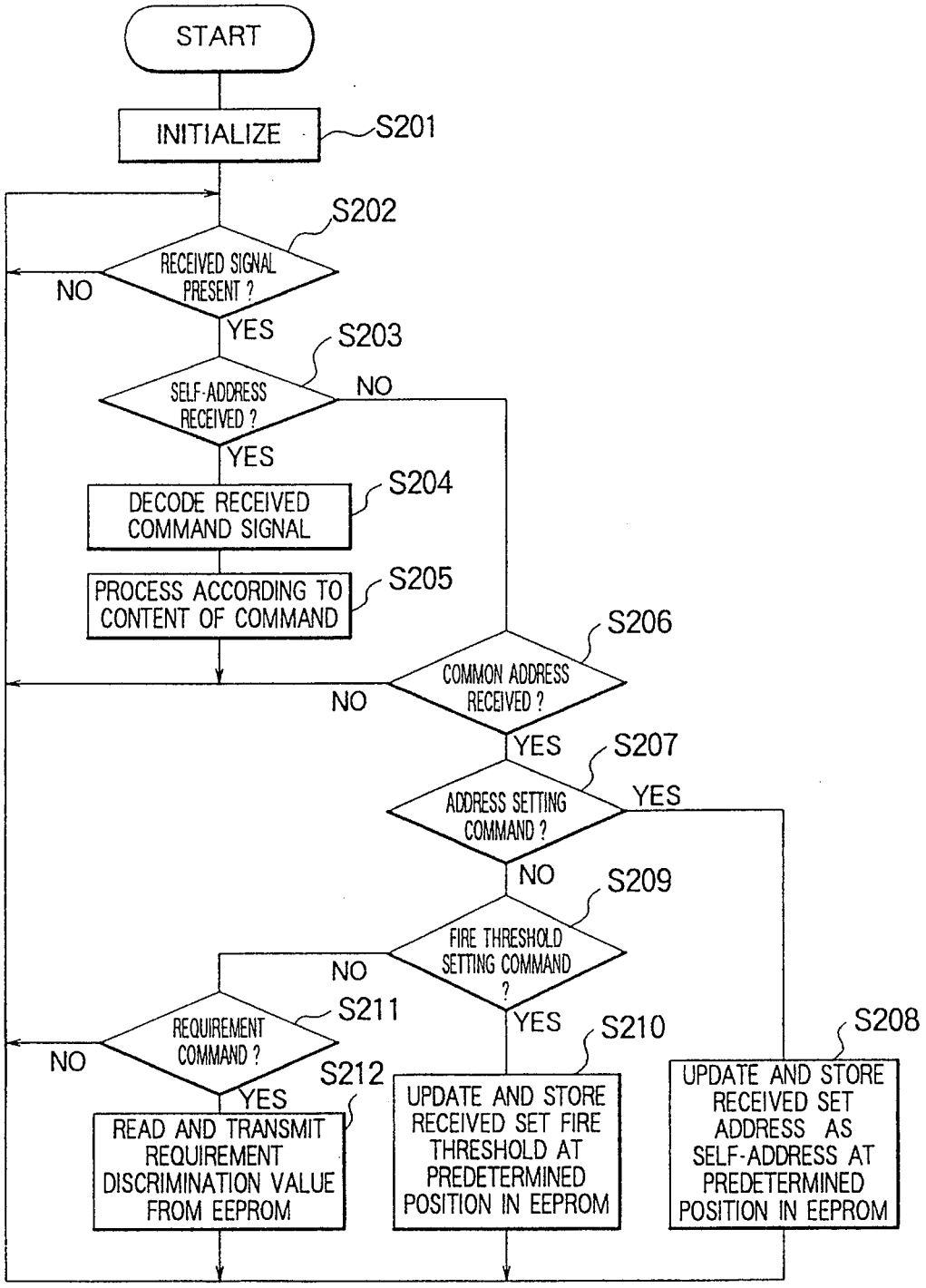
FIG. 12 is a flow chart for use to describe the operation of the fire detector shown in FIG. 10.

Initially, the operation of the fire detector 100 will now be described with reference to FIG. 12. Note that all discrimination operations are performed by the MPU 120 in the following operations.

In step S201 the RAM 170 and the IF's 190 and 191 are initialized. In step S202 whether or not a signal has been received from the setting unit 200 or the fire receiver 400 is discriminated. If no signal has been received, receipt of the signal is waited for. If the signal has been received, whether or not the received signal is the self-address, which is a call signal from the fire receiver 400, is discriminated in step S203. If it is the self-address, the received command signal (for example, the type return command, the status information return command, the test command or test result return command) is decoded in step S204. In step S205 a process according to the received command is performed. If the command signal is the status information return command for example, a process for transmitting an output denoting the result of the detection (the physical quantity signal of the fire phenomenon or presence/absence of the fire signal) and the like are performed. Then, the flow returns to step S202 in which the foregoing operations are repeated.

If the received signal is not the self-address in step S203, whether or not the received signal is the common address supplied from the setting unit 200 is discriminated in step S206. If it is not the common address, the flow returns to step S202 in which the foregoing operations are repeated. If it is the common address, whether or not it is the address setting command is discriminated in step S207. If it is the address setting command, the flow proceeds to step S208 in which the received set address is, as the self-address, stored at a predetermined position in the EEPROM 160 while updating the former address.

If a discrimination has been made in step S207 that it is not the address setting command, whether or not it is the discrimination value setting command, that is, the fire threshold (the threshold for discriminating a fire) setting command is discriminated in step S209 in this case. If it is the fire threshold setting command, the flow proceeds to step S210 in which the received set fire threshold is stored at a predetermined position in the EEPROM 160 while updating the former threshold.

If a discrimination has been made in step S209 that it is not the fire threshold setting command, whether or not it is the command of requiring a discrimination value or the like is discriminated in step S211. If it is the requirement command, the discrimination value or the like required by the EEPROM 160, that is, the self-address or a fire threshold, is read so as to transmit the read self-address or the fire threshold to the setting unit 200 through the transmitting/receiving portion 192 in step S212. If it is not the requirement command, the flow returns to step S202 in which the foregoing operation is repeated.

Figure 13:
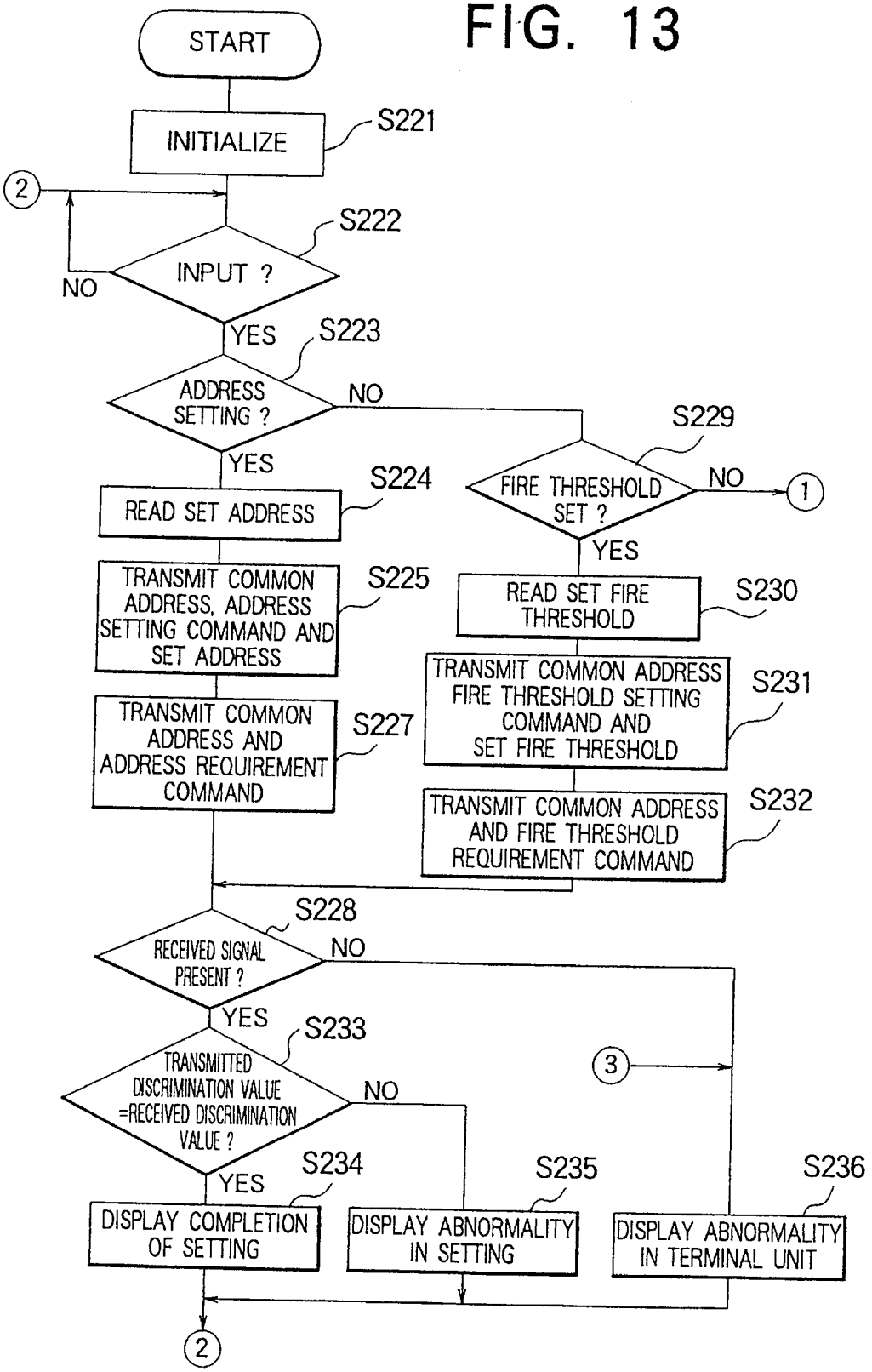
FIG. 13 is a flow chart for use to describe the operation of the setting unit shown in FIG. 10.
Figure 14:
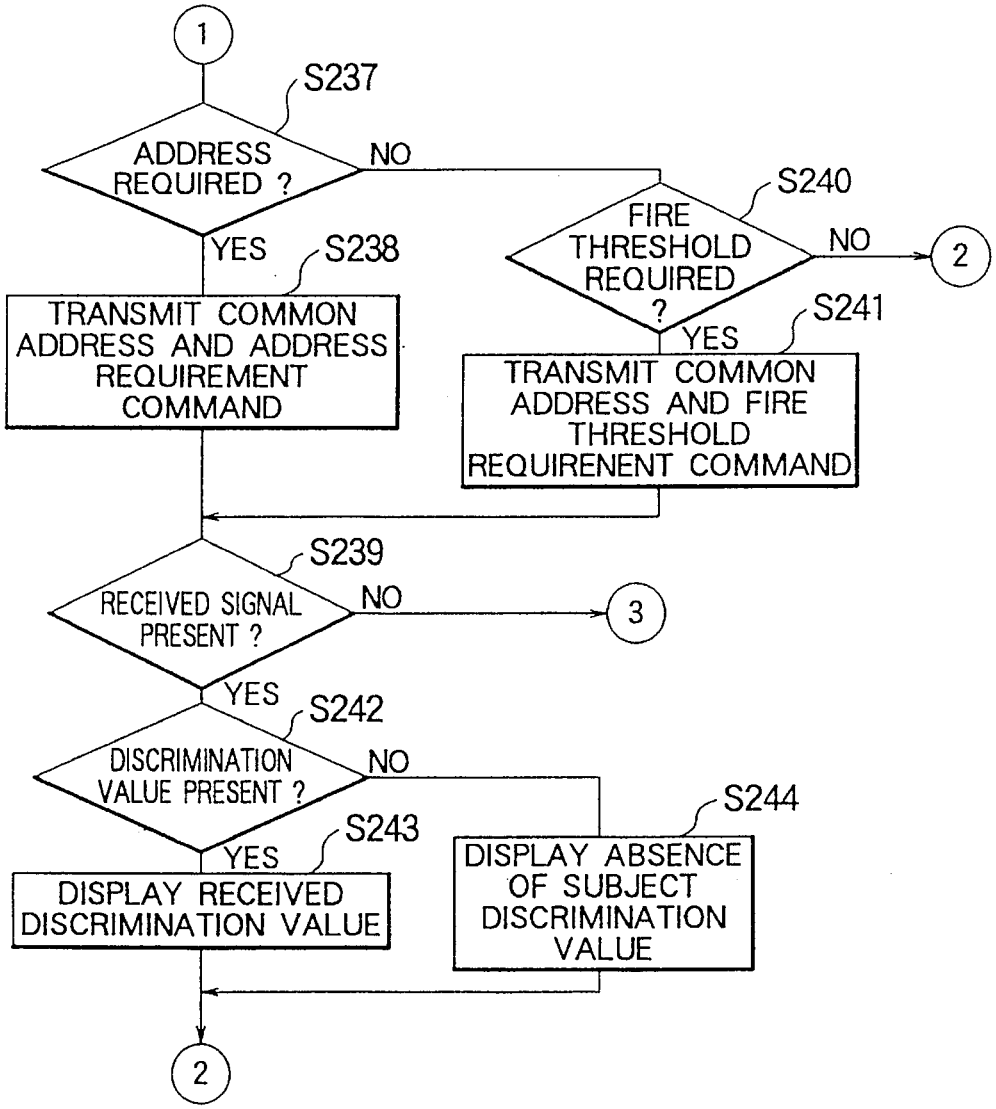
FIG. 14 is a flow chart for use to describe the operation of the setting unit shown in FIG. 10.

The operation of the setting unit 200 will now be described with reference to FIGS. 13 and 14. All discrimination operations in the following process are performed by the MPU 210.

In step S221, the RAM 250, the IF's 240, 290 and 291 and the like are initialized. In step S222 whether or not an input from the input portion 260 is present is discriminated. If no input is present, input is waited for. If an input is present, whether or not it is address setting is discriminated in step S223. If it is address setting, the flow proceeds to step S224 in which the set address is read from the input portion 260. In step S225 the common address and the address setting command are added to the set address to transmit the result of the addition to the fire detector 100 through the transmitting/receiving portion 293. In step S227 whether or not the address setting has been performed assuredly is confirmed by adding the address requirement command to the common address and by transmitting the result of the addition to the fire detector 100 through the transmitting/receiving portion. Then, the flow proceeds to step S228.

If a discrimination has been made in step S223 that it is not address setting, whether or not setting of the discrimination value, that is, setting of the fire threshold is discriminated in step S229. If it is setting of the fire threshold, the fire threshold is read from the input portion 260 in step S230. In step S231 the common address, the fire threshold setting command and the set fire threshold are transmitted to the fire detector 100 through the transmitting/receiving portion 293. In step S232 the common address and the fire threshold are transmitted to the fire detector 100 through the transmitting/receiving portion 293. Then, the flow proceeds to step S228.

In step S228 whether or not a signal has been received (returned) from the fire detector 100 is discriminated. If a signal has been received, whether or not the set address or the fire threshold, which is the discrimination value transmitted in step S226 or step S231, and the received discrimination value coincide with each other is discriminated in step S233. For example, if the set (self) address has been returned from the fire detector 100, whether or not the received self-address coincides with the set address transmitted to the fire detector 100 at the time of setting the address is discriminated. If they coincide with each other, the result is displayed and completion of setting is displayed on the display portion 280. When the display is performed, the thus-received data, which has been returned as described above, may be, as it is or after it has been converted into a recognizable state, displayed on the display portion 280.

If the transmitted set address or the fire threshold does not coincide with the received discrimination value in step S225 or step S231, the abnormality of setting is displayed on the display portion 280 in step S235. Similarly, if no signal is, in step S228, received (returned) from the fire detector 100 within a predetermined time, abnormality of the fire detector 100, which is one of the terminal units, is displayed on the display portion 280 in step S236.

When display operation in each of steps S234, S235 and S236 has been completed, the flow returns to step S222 in which the foregoing operations are repeated.

If it is not setting of the fire threshold in step S229, the flow proceeds to step S237 so as to know the set address (self-address) of the fire receiver 100. Thus, whether or not it is the address requirement command is discriminated in step S237. If it is the address requirement command, the common address and the address requirement command are transmitted to the fire detector 100 through the transmitting/receiving portion 293 in step S238. Then, the flow proceeds to step S239.

If it is not the address requirement command in step S237, the flow proceeds to step S240 in which whether or not it is the fire threshold requirement command to know the fire threshold of the fire receiver 100 is discriminated. If it is the fire threshold requirement command, the common address and the fire threshold requirement command are transmitted to the fire detector 100 through the transmitting/receiving portion 293 in step S241. Then, the flow proceeds to step S239.

In step S239 whether or not a signal has been received (returned) from the fire detector 100 is discriminated. If a signal has been received, whether or not the received signal is the discrimination value, for example, whether or not the set address, that is, the self-address has been received from the fire detector 100 is discriminated in step S242. If it has been received, the received discrimination value, for example, the self-address, is displayed on the display portion 228 in step S243. If no discrimination value has been received, the fact that the discrimination value has not been received, that is, the fact that the required discrimination value, for example, the self-address, has not been set into the fire receiver 100, is displayed on the display portion 280 in step S244.

When the display operations in step S243 and S244 have been completed, the flow returns to step S222 in which the foregoing operations are repeated.

If no fire requirement command is present in step S240, the flow returns to step S222 in which the foregoing operations are repeated. If no signal is received from the fire detector 100 within a predetermined time in step S239, the flow returns to step S236 in which the fact that the fire detector 100 has encountered abnormality is displayed on the display portion 280 similarly to the above process.

When new address or a threshold for discriminating a fire has been set as a discrimination value into the fire detector 100, the fire detector 100 is removed from the setting unit 200 so as to be brought to the spot at which it must be installed or the same is again connected to the electric path.

If the fire detectors 100 to **100*n* connected to the fire receiver 400 discriminate that they are called from the fire receiver 400 in the case where the received address coincides with the self-address as shown in FIG. 15, they decode the received command signals and perform the required operations so that data required by the fire receiver 400** is transmitted.

As described above, this embodiment has an arrangement that, when a discrimination value including the address and the like of the fire detector, which is one of the terminal units, is set, the setting unit transmits the address setting command and the set address together with the common address. When the received signal has been present, the fire detector discriminates whether it is the self-address, which is a call signal from the fire receiver, or the common address supplied from the setting unit. If it is the common address, the set address is stored when the address setting command and the set address have been received and the discrimination value is set by using the address peculiar to each fire detector. Therefore, when address is set to a new fire detector having no address, the fire receiver is able to reliably call the fire detector. Furthermore, an erroneous address setting operation performed by the fire detector due to polling in the normal fire supervisory can be prevented. Therefore, the discrimination value including the address and the like can assuredly be set.

Since the set address requirement command is, together with the common address, transmitted from the setting unit to the fire detector and the fire detector reads the set (self) address required by the EEPROM to return it, unknown discrimination values of the fire detector, such as the self-address and the threshold for discriminating a fire, can easily be detected by transmitting the discrimination value requirement command from the setting unit to the fire detector together with the common address.

Although the foregoing embodiment has the arrangement that the address value and the threshold for discriminating a fire are used as the discrimination values to be set to the EEPROM, the present invention is not limited to this. The structure of this embodiment can be applied to a case where another discrimination value is used, for example, a threshold for discriminating a trouble, a threshold for test discrimination, set time for a timer (for example, time for control) or the type of the terminal unit (for example, heat type, photoelectric type, light obscuration type, ionization type, flame type, gas type, smell type, manual box, supervisory transmitter, control transmitter, special type, type-1, type-2 or type-3).

Although the foregoing embodiment has been described about the structure in which the fire detector is used as an example of the terminal unit of the fire alarm system, the present invention is not limited to this. In an example case where the terminal unit is a supervisory transmitter, the receiving circuit for receiving a fire signal or a physical quantity signal of the fire signal transmitted by the fire detector or the like is used in place of the fire detection portion. If it is the control transmitter, a control circuit is required to be used in place of the fire detection portion, the control circuit being arranged to transmit electric power or a control signal to the units to be controlled, such as fire block doors, smoke preventing and exhausting units or fire extinguishing units and to supervise the states (for example, opened state or closed state) of the units to be controlled. If the terminal unit is a manual box, a push button is required to be as well as provided in place of the fire detection portion. In either case, an effect similar to the foregoing structure can be obtained.

In the foregoing embodiment, the setting command to be transmitted by the setting unit to the fire detector may be setting commands individually corresponding to discrimination values or a common setting command common to various discrimination values.

The return command to be transmitted by the setting unit to the fire detector may be return commands individually corresponding to the various discrimination values or a common return command common to the various discrimination values. If the return command is the individual return commands, the fire detector reads each of data items (for example, addresses, thresholds for discriminating a fire) corresponding to the return commands to transmit the read data. If the return command is the common return command, the fire detector reads all data items stored in the EEPROM to transmit read data.

What is claimed is:

1. A fire alarm system comprising:

terminal units; and a setting unit for setting a variety of set values to said terminal units; wherein said setting unit comprises:

first command means for transmitting a first command and said set value to said terminal unit;

first discrimination means that receives a first response signal and said set value from said terminal unit in accordance with said first command to discriminate whether or not said set value received from said terminal unit coincides with said set value transmitted by said first command means;

second command means for transmitting a second command and said set value to said terminal unit when said first discrimination means has discriminated that said set value received from said terminal unit coincides with said set value transmitted by said first command means; and second discrimination means that receives a second response signal and said set value from said terminal unit in accordance with said second command to discriminate whether or not said set value received from said terminal unit coincides with said set value transmitted by said first command means or said second command means;

wherein said terminal unit comprises:

first response means that transmits a first response signal and said received set value to said setting unit when receiving said first command and said set value from said first command means;

second response means that discriminates whether or not said received set value coincides with said set value received by said first response means when receiving said second command and said set value from said second command means and transmits a second response signal and said received set value to said setting unit when said two set values coincide with each other; and writing means for storing a result of discrimination in storage means when said second response means has discriminated that said two received set values coincide with each other.

2. A fire alarm system according to claim 1 wherein said setting unit further comprises third discrimination means for discriminating, in accordance with a result of discrimination performed by said second discrimination means, validity of a state where said set value of said terminal unit is set.

3. A fire alarm system according to claim 2 wherein said third discrimination means comprises:

third command means for transmitting a third command for requiring a set value of the same type as those transmitted by said first command means and said second command means to said terminal unit when said second discrimination means has discriminated that said set value received from said terminal unit coincides with said set value transmitted by said first command means or said second command means; and fourth discrimination means for discriminating whether or not said set value received from said terminal unit in accordance with said third command coincides with said set value transmitted by said first command means or said second command means;

wherein said terminal unit further comprises:

third response means that reads, from said storage means, said set value specified by said third command when said third command has been received from said third command means, and transmits said set value, which has been read, to said setting unit.

4. A fire alarm system according to claim 2 or 3 wherein said discrimination means comprises display means for displaying a result of discrimination performed by said third discrimination means.

5. A fire alarm system according to claim 2 or 3 wherein said setting unit further comprises:

fourth command means for transmitting a fourth command that specifies the type of said set value and requires said set value to said terminal unit; and display means for displaying said set value received from said terminal unit in accordance with said fourth command;

wherein said terminal unit further comprises:

fourth response means that reads, from said storage means, said set value specified in accordance with said fourth command when said fourth command has been received from said fourth command means, and transmits said read set value to said setting unit.

6. A fire alarm system according to claim 2 or 3 wherein said setting unit further comprises:

fourth command means for transmitting, to said terminal unit, a fourth command that specifies the type of said set value and requires said set value; and display means for displaying said set value received from said terminal unit in accordance with said fourth command;

wherein said terminal unit further comprises:

fourth response means that reads, from said storage means, said set value in accordance with said fourth command when said fourth response means has received said fourth command from said fourth command means, and transmits said read set value to said setting unit;

wherein said third discrimination means displays a result of discrimination performed by said third discrimination means.

7. A fire alarm system according to claim 2 or 3 wherein said setting unit further comprises:

fourth command means for transmitting, to said terminal unit, a fourth command that specifies the type of said set value and requires said set value; and display means for displaying said set value received from said terminal unit in accordance with said fourth command;

wherein said terminal unit further comprises:

fourth response means that reads, from said storage means, said set value in accordance with said fourth command when said fourth response means has received said fourth command from said fourth command means, and transmits said read set value to said setting unit;

wherein a common address is set for a plurality of terminal units, said first to fourth command means of said setting unit being adapted to simultaneously transmit said common address, said first to fourth response means being adapted to discriminate whether or not said command and said set value or said command together with said common address have been received.

8. A fire alarm system comprising:

a plurality of terminal units; and a setting unit for setting a variety of discrimination values to said terminal unit; wherein said setting unit comprises:

input means for inputting a variety of discrimination values;

discrimination means for discriminating said variety of discrimination values inputted by said input means; and transmission means that adds a common address, which is common for said plurality of terminal units, to said discrimination values discriminated by said discrimination means and transmits said discrimination values having said common address to said terminal units;

wherein each of said terminal units comprises:

a first storage means in which said common address is pre-stored;

a second storage means for storing an inherent self-address of said terminal unit, said second storage means being an electrically erasable and rewritable non-volatile storage means;

receiving means for receiving information transmitted by said setting unit;

discrimination means for discriminating whether said common address is included in the information received by said receiving means and for discriminating said discrimination values in accordance with the information received by said receiving means when said common address has been received; and writing means for storing a result of discrimination performed by said discrimination means into said second storage means.

9. A fire alarm system according to claim 8 wherein said discrimination means of said setting unit comprises:

setting discrimination means for discriminating whether or not an input from said input means is setting; and requirement discrimination means for discriminating whether or not said input from said input means requires said terminal unit to return information.

10. A fire alarm system according to claim 8 or 9 wherein said discrimination means of said setting unit further comprises discrimination value discrimination means for discriminating whether or not said discrimination value returned from said terminal unit and said discrimination value input by said input means coincide with each other.

11. A fire alarm system according to claim 9 wherein said discrimination means comprises:

address setting discrimination means for discriminating whether or not said input from said input means is setting of address; and discrimination value setting discrimination means for discriminating whether or not said input from said input means is setting of said discrimination value, and said requirement discrimination means comprises:

address requirement discrimination means for discriminating whether or not said input from said input means requires said terminal unit to return said address; and discrimination value requirement discrimination means for discriminating whether or not said input from said input means requires said terminal unit to return said discrimination value.

12. A fire alarm system according to claim 11 wherein said discrimination means of said setting unit further comprises discrimination value discrimination means for discriminating whether or not said discrimination value returned from said terminal unit and said discrimination value input by said input means coincide with each other.

13. A fire alarm system according to claim 12 wherein said setting unit further comprises:

receiving means that receives information from said terminal unit and supplies the same to said discrimination value discrimination means; and display means for displaying a result of discrimination performed by said discrimination value discrimination means.

14. A fire alarm system according to claim 8 wherein said discrimination means of said terminal unit comprises:

common address discrimination means that makes a reference to said storage means in accordance with an output from said receiving means and discriminates whether or not said common address has been received;

setting command discrimination means for discriminating whether or not said setting command has been, together with said common address, received in accordance with an output from said receiving means when said common address discrimination means has discriminated receipt of said common address; and requirement command discrimination means for discriminating whether or not said discrimination value requirement command has been, together with said common address, received in accordance with an output from said receiving means when said common address discrimination means has discriminated receipt of said common address.

15. A fire alarm system according to claim 14 wherein said setting command discrimination means comprises:

address setting command discrimination means for discriminating whether or not said received setting command is said address setting command when said common address discrimination means has discriminated receipt of said common address; and discrimination value setting command discrimination means for discriminating whether or not said receiving setting command is said discrimination value setting command when said common address discrimination means has received said common address.

16. A fire alarm system according to any one of claims 8, 14 or 15 wherein said terminal unit further comprises transmitting means that reads, from said non-volatile storage means, a discrimination value corresponding to a requirement command received after said common address has been received and transmits said discrimination value to said setting unit.

* * * * *